United States Patent [19]

Biller et al.

[11] 4,422,062

[45] Dec. 20, 1983

[54] APPARATUS FOR ASSOCIATING AN ELECTRICAL DEVICE WITH A MOUNTING THEREFOR

[75] Inventors: Bruce A. Biller, Chicago; Henry W. Scherer, Mt. Prospect; Roy Swanson, North Riverside, all of Ill.

[73] Assignee: S&C Electric Company, Chicago, Ill.

[21] Appl. No.: 433,077

[22] Filed: Oct. 6, 1982

[51] Int. Cl.[3] ..... H01H 71/10

[52] U.S. Cl. ..... 337/171; 337/174

[58] Field of Search ..... 337/150, 154, 168, 169, 337/170, 171, 172, 174, 175, 177, 178

[56] References Cited

U.S. PATENT DOCUMENTS

| | | | |
|---|---|---|---|
| 2,843,703 | 7/1958 | Grepe | 337/174 X |
| 3,447,114 | 5/1969 | Frink et al. | 337/171 |
| 3,827,010 | 7/1974 | Cameron et al. | 337/171 X |

*Primary Examiner*—George Harris

[57] ABSTRACT

A pull-ring for an electrical device, such as a high-voltage fuse, which may be placed in a mounting. The pull-ring operates a latch, which is capable of holding the fuse closed in the mounting, only when it is reciprocated. The pull-ring is pivotable independently of its reciprocation without affecting the condition of the latch. Accordingly, when a trunnion on the device is in a hinge of the mounting and a pushing force is applied to the pull-ring with a tool to close the device, the natural decrease in the interior angle between the tool and the device can rotate the pull-ring without preventing the latch from holding the device closed. Further, whether the pushing force or a pulling (opening) force is applied to the pull-ring, the direction of application of the force may be adjusted or may naturally change before, during,or after such force application with affecting the ability of the latch to hold the device closed. The tool may, therefore, be either a non-grasping tool (a "hot stick") or one (a "shotgun stick") capable of grasping the pull-ring. In the latter event, when the tool grasps the pull-ring and the trunnion is out of the hinge, the pull-ring is biased to a pivotal orientation whereat the trunnion is presented for convenient insertion into the hinge upon manipulation of the tool.

33 Claims, 24 Drawing Figures

12
14
94
28
26
36
128
120
130
52
102
30
80
84
124
126
134
124
132
66
56
60
74
70
72
92
136
68
82
64
78
62
50
20
24
122
16
40
32
32
10
16
32
34
10b
10b
174
176
42
140
18
158
170a
48
44
170
172a
142
172
178
152
156
164
151
154
154a
153a
162
46
160
158
148
22
166
150
153
144
38

26
28
36
40
130
128
124
126
132
72
134
124
120
122
14
136
20
52
102
98a
104
30
80
56
66
92
105
78
82
70
74
98
76
84
50
68
60
64
98b
24
62
32
10
16
94
34
174
172
42
140
18
172a
170a
170
156
158
176
146
154
152
142
156
144
22
158
164
154a
160
162
148
153a
166
150
153
151
38

FIG-9
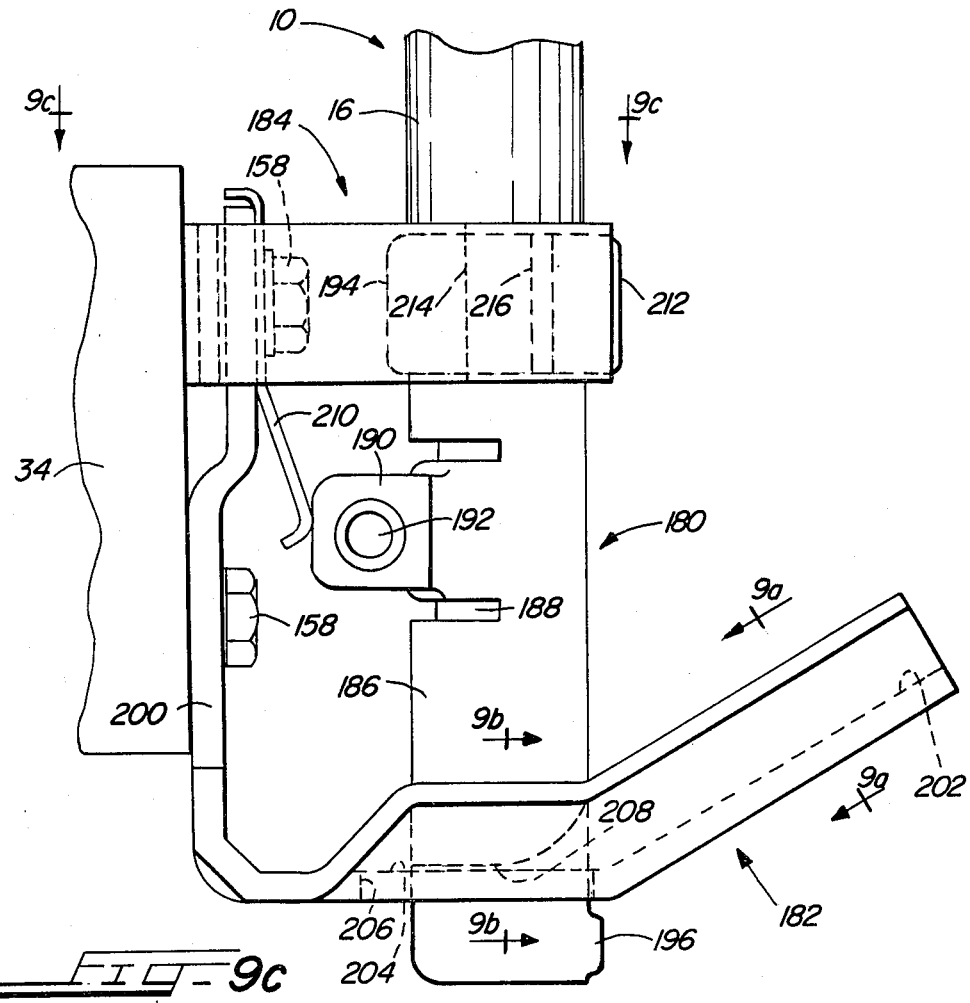
FIG-9c
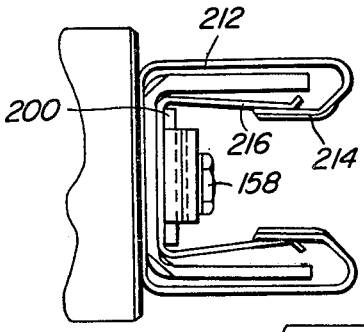
FIG-9a
FIG-9b
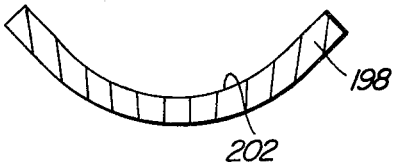
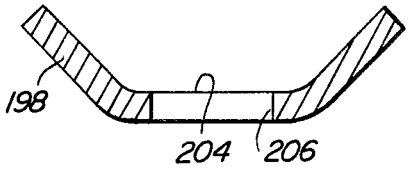

APPARATUS FOR ASSOCIATING AN ELECTRICAL DEVICE WITH A MOUNTING THEREFOR

BACKGROUND OF THE INVENTION

1. Field of the Invention

The present invention relates to improved apparatus for associating an electrical device with a mounting therfor and, more particularly, to improved apparatus for maintaining an electrical device closed in a mounting, for permitting convenient opening of the closed device in the mounting and removal of the opened device therefrom, and for facilitating convenient and easy insertion of the device, and closing of the inserted device, in the mounting.

2. Discussion of the Prior Art

Electrical devices or components, such as power fuses, current-limiting fuses, and blades, may be included in electrical circuits and may be located on a utility pole or on a wall of a vault or room, or may be present in pad-mounted or metal-enclosed electrical gear. The devices are normally held closed and latched in a mounting, in which they may be both moved to affect the continuity of the circuit and to be rendered accessible for inspection, removal or replacement.

A typical device mounting includes first and second spaced brackets which may be affixed by spaced insulators to a utility pole, a wall of a vault or room, or a wall or panel of an enclosure or cabinet. When the device is closed and latched in the mounting, each of the spaced brackets is adjacent to a respective end of the device. One end of the device, usually the lower one, may include or carry a trunnion which is selectively insertable into and removable from a hinge on the first, lower bracket. When the trunnion is in the hinge, the device is rotatable to move the second end of the device toward the second, upper bracket during closing movement of the device and to move the second end of the device away from the second bracket during opening movement of the device. The second end of the device may include or carry an assembly, such as a pull-ring or the like, which is manipulable by a tool such as a "hot stick." The trunnion and the pull-ring may be integral with the device (as is typical with blades) or may be carried by or be integral with fittings permanently or removably mounted to the ends of the device (as is typical with fuses).

The following operations involving the device are typically performed at various times: (1) insertion of the trunnion into the hinge, (2) rotation of the device after such insertion to close and latch the device upon application to the assembly of a pushing force, (3) unlatching and rotation of the device when the trunnion is in the hinge for opening the device upon application to the assembly of a pulling force, and (4) removal of the trunnion from the hinge, after the device is open, for inspection, replacement, or the like. A typical pull-ring (or similar assembly) on the device rather easily permits operations (2) and (3) to be performed with a standard "hot stick." Specifically, a hook or prong on the "hot stick" may be easily engaged with an aperture or "eye" of the pull-ring, following which the pushing or pulling force may be easily applied. However, where the device includes a prior art pull-ring, operations (1) and (4) usually require the use of one or more additional tools, a plurality of different maneuvers with the "hot stick," or both.

Since the hook or prong of a standard "hot stick" cannot grasp the pull-ring or the body of the device (it can only pull or push on the pull-ring), the performance of operation (1) or (4), following the performance of operation (2) or (3), requires the use of an additional tool which can both engage the pull-ring and support the body of the device (for example, a tool such as the GRAPPLER, sold by the assignee hereof), the use of an additional tool such as a clamp which can engage the body of the device, or repositioning of the hook or prong. The use of either of the two additional tools (which normally occurs where the mounting is a so-called 45° opening mounting) permits the device to be lifted and transported, thus permitting the trunnion to be either inserted into or removed from the hinge. Repositioning of the hook or prong is typical with so-called 180° opening mountings. When the device is opened in such a mounting, the trunnion is pivoted 180° from its normal orientation in the hinge, so that the "top" of the device hangs "down." Following opening of the device, the hook or prong is removed from the pull-ring, engaged with an "eye" in the trunnion, and lifted to remove the trunnion from the hinge. Insertion of the trunnion into the hinge and closing of the device are achieved by a reverse, multi-step sequence.

A tool often referred to as a "shotgun stick" is known. This tool, which is typically used to remove or emplace a so-called "elbow," includes a hook-like member which may grasp or clamp a pull-ring or an "eye" on the elbow for removal or emplacement thereof. "Shotgun sticks" have not typically been used to manipulate devices such as blades or fuses for reasons developed below.

In many prior art arrangements, manipulation of the pull-ring is required to unlatch and open the device. This manipulation may comprise engaging the pull-ring with the hook or prong of a "hot stick" and then rotating or pivoting the pull-ring in a vertical plane. Pivoting or rotation of the pull-ring may move a latch lever carried by the upper end of the device to disengage the latch lever from a latch member, such as a protruding lip or other feature, on the second, upper bracket. In some arrangements, pivoting of the pull-ring moves a latch member carried by the upper bracket out of engagement with a lip or other feature on the upper end of the device. In either event, after the upper end of the device is no longer latched and held in the upper bracket and the device is opened, the pull-ring and/or the body of the device are grasped or otherwise supported and the electrical device is lifted upwardly to remove the trunnion from the hinge along the lines described above.

Since the unlatching, opening, and removal of the device can usually be achieved with a "hot stick" alone or by the use of a tool in addition thereto, there is no need to use a "shotgun stick," although such use is theoretically possible. Further, it is also theoretically possible that the grasping performable by a "shotgun stick" might enable the devices of prior art arrangements to be unlatched, opened, and removed therewith, although such is far from common (if it occurs at all). Unlatching manipulation of prior art assemblies requires that a worker rotate or pivot the pull-ring. At times, the relative height of the worker, the tool manipulated thereby (whether a "hot stick" or a "shotgun stick"), and the pull-ring are such that application of a rotative or pivoting force to the pull-ring is inconvenient or quite difficult. Further, if a "shotgun stick" were to be used to unlatch or open the fuse, binding might occur if the "shotgun stick" too firmly grasped the pull-ring as the pull-ring or the device rotates. At least opening rotation of the pull-ring requires that the interior angle between the device and the tool be able to freely increase. The lack of assurance that such binding will not occur (and is easily avoidable when a "hot stick" is used) probably accounts, in part, for "shotgun sticks" not being used to open devices in the past. Further, if the tool is a "shotgun stick" which firmly grasps the pull-ring, binding may be experienced as the device is being opened and the interior angle between the tool and the device tends to increase.

After reinsertion of the trunnion into the hinge (following removal of the device from the mounting), closing rotation of the device causes the interior angle between the tool and the device to decrease. Such a decrease is easily achieved with a "hot stick," the hook or prong of which does not bind in the pull-ring. However, if the tool is a "shotgun stick" or other tool which grasps the pull-ring, the decrease in this interior angle may effect a rotative or pivoting motion of the pull-ring, as well as binding. Rotation of the pull-ring as the device is being closed may result in the pull-ring being sufficiently rotated to prevent latching of the upper end fitting in the upper bracket when the device is supposed to be closed. Whether this last-noted effect occurs or not, the decrease in the interior angle between the tool and device may, again, result in binding if the tool too firmly grasps the pull-ring.

Attempts to insert the trunnion into the hinge may be achieved with the worker holding the tool level with, slightly above, or slightly below the lower bracket. Unless the tool includes facilities for supporting the device, in prior art arrangements, the trunnion is usually not presented at a convenient angle relative to the hinge for easy insertion thereinto, absent clumsy or strenuous manipulation of the tool and the device.

Lastly, in opening or closing the device, the worker may attempt to adjust the tool to a convenient angle of attack for the application of the pulling or pushing force to the tool and the pull-ring. It the tool grasps the pull-ring, this adjustment may pivot or rotate the pull-ring to effect untimely unlatching of the upper end fitting from the upper bracket, or to render the upper end fitting incapable of being latched in the upper bracket when such latching is desired.

One object of the present invention is to provide improved apparatus for associating an electrical device with a mounting therefor which avoids the above described shortcomings. Another object of the present invention is to provide improved apparatus for associating an electrical device with a mounting therefor which contains few parts and is simple and economical to construct.

SUMMARY OF THE INVENTION

With the above and other objects in view, the present invention, in its broadest aspect, comprises improved apparatus for associating an electrical device with a mounting therefor. The mounting is generally known in the prior art and includes first and second insulatively spaced brackets, each of which is adjacent to a respective end of the device or a fitting thereon, when the device is closed in the mounting. One end of the device, or the fitting thereon, carries a trunnion, which is insertable into and removable from a hinge on the first bracket. The device is rotatable when the trunnion is in the hinge to move the other end of the device, or the fitting thereon, toward the second bracket during closing movement thereof and away from the second bracket during opening movement thereof. The other end of the device, or the fitting thereon, carries an assembly, such as a pull-ring or the like, which is manipulable (1) to insert the trunnion into the hinge, (2) to rotate the device after such insertion for closing the device upon application to the assembly of a pushing force generally transverse to the device, (3) to rotate the device when the trunnion is in the hinge for opening the device upon application to the assembly of a pulling force generally transverse to the device, and (4) to remove the trunnion from the hinge after such opening. The second bracket includes a latch member. The other end of the device, or the fitting thereon, carries a latch. The latch is movable between a normal first position, whereat the latch and the latch member are engageable, and a second position, whereat the latch and the latch member are disengageable. Engagement between the latch and the latch member when the trunnion is in the hinge maintains the device closed. Disengagement of the latch and the latch member when the trunnion in the hinge permits the device to be opened. The device may be a power fuse, a current-limiting fuse, a blade, or other electrical component.

According to the improvement of the present invention, a first mounting facility mounts the assembly to the other end of the device, or to the fitting thereon, for limited reciprocating, back-and-forth movement of the assembly from a first normal location to a second location upon application of the pulling force to the assembly. The first and second locations reside at different distances from the device on a line of reciprocating movement which is generally transverse to the device. The latch is moved out of its first position and toward its second position in response to reciprocating movement of the assembly out of its first location and toward its second location. A second mounting facility mounts the assembly to the other end of the device, or to the fitting thereon, for limited pivoting thereon relative to the device. This limited pivoting is independent of the reciprocating movement of the assembly and does not affect the location of the assembly along its line of reciprocating movement. As the assembly is pivoted, the line of reciprocating movement of the assembly may assume different, though generally transverse, orientations relative to the device in the various pivotal orientations thereof. Because the assembly may be pivoted independently of the reciprocating movement thereof, and vice versa, the pivotal orientation of the assembly is continuously changeable or adjustable before, during and after the application of the pushing force or the pulling force thereto without affecting the position of the latch. Further, the assembly may be reciprocated regardless of its pivotal orientation.

As a consequence of the above, with the trunnion in the hinge and the device closed, the pivotal orientation of the assembly may be adjusted to a convenient angle of attack or may change before, or as a result of, the application of the pulling force thereto. This adjustment or change does not disengage the latch from the latch member. After or concurrently with the adjustment to a convenient angle of attack or the change, the application of the pulling force to the assembly reciprocates the assembly to its second location, moving the latch to its second position, whereat the latch member is disengaged. As a consequence, the application, in a more or less continuous manner, of the pulling force to the assembly with the device closed in the mounting is capable of serially effecting disengagement of the latch from the latch member, opening of the device, and removal of the trunnion from the hinge in a convenient, easy manner.

Further, the trunnion may be inserted into and removed from the hinge when the device assumes a selected angular open orientation relative to the mounting. The assembly may be grasped by a tool when the trunnion is out of the hinge. Such grasping limits or prevents motion between the grasped assembly and the tool. The assembly is biased toward a predetermined pivotal orientation relative to the device. This is effective to maintain the grasped assembly and the tool in the predetermined pivotal orientation. Consequently, upon appropriate manipulation of the tool, the device generally assumes and remains in the selected angular orientation relative to the mounting to facilitate insertion of the trunnion into the hinge. Afterwards, application of the pushing force to the grasped assembly by the tool pivots the assembly (and the tool) against the biasing action thereon out of the predetermined pivotal orientation as the device undergoes closing movement and the interior angle between the tool and the device decreases. Since this pivoting does not affect the normal position of the latch, the latch remains in a condition whereby the device is held closed after undergoing sufficient closing movement, notwithstanding the pivoting of the assembly.

Thus, the device may be (a) opened and removed from the mounting by applying the pulling force in a more or less continuous manner with a single tool, which, whether or not it grasps the assembly, may be intentionally adjusted, or may otherwise change, so that the tool is manipulable from a convenient angle of attack at all times without inadvertently affecting the position of the latch; (b) inserted into the mounting by applying the pushing force in a more or less continuous manner with a single tool, which, whether or not it grasps the assembly, may be intentionally adjusted, or may otherwise change without binding, so that the tool is manipulable from a convenient angle of attack at all times without inadvertently affecting the position of the latch; and (c) pick up when it is out of the mounting so that its trunnion is presented for convenient insertion into the hinge, following which (b) may be carried out.

BRIEF DESCRIPTION OF THE DRAWING

FIG. 9 is a side elevation of a lower bracket which is an alternative to that shown in FIGS. 2 and 2*a;*

FIGS. 9*a* and 9*b* are sectional views of a portion of the alternative lower bracket depicted in FIG. 9 taken along lines 9*a*—9*a* and 9*b*—*b* thereof, respectively;

FIG. 9*c* is a top view of a contact portion of the lower bracket depicted in FIG. 9 and taken along lines 9*c*—9*c* thereof;

DETAILED DESCRIPTION

General

Figure 1:
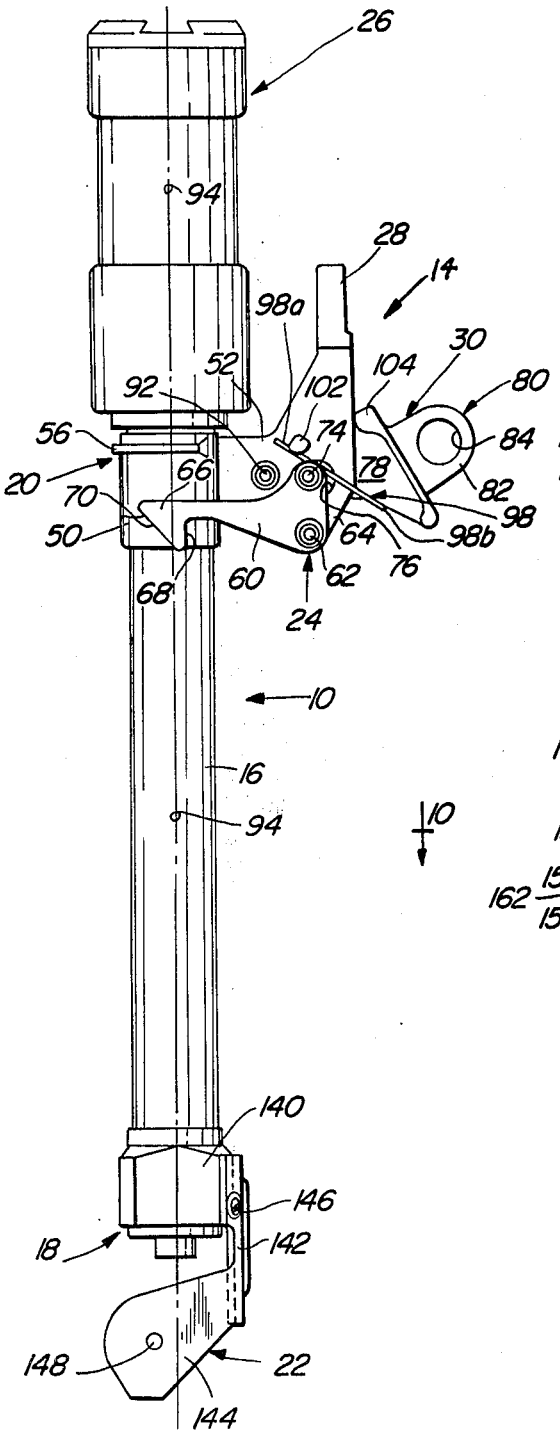
FIG. 1 is a side-elevation of a fuse having upper and lower end fittings thereon, the upper end fitting including improved apparatus according to the present invention.

The present invention generally relates to improved apparatus for associating an electrical device with a mounting therefore and for permitting selective removal of the device from the mounting and insertion of the device into the mounting. The present invention is advantageously, though not necessarily, usable with the invention of commonly-assigned, co-pending U.S. patent application, Ser. No. 346,432, filed Feb. 5, 1982 (hereinafter the '432 application).

The invention of the '432 application relates to a handling arrangement for an electrical device such as a high-voltage fuse, one example 10 of which is depicted in FIGS. 1, 2, 4, 4*a*, and 4*b*. As described in the '432 application, the fuse 10 or other electrical device may be variously located either inaccessibly behind a wall or accessibly in front of the wall. The wall typically forms a part of a cabinent or enclosure and contains an opening therethrough. The fuse 10 may be placed in a mounting so that it overlies one surface of a support member, such as a panel, shown generally at 12 in FIGS. 2 and 2*a* and in greater detail in the '432 application. The panel 12 is attached to the wall so that it may be simultaneously moved and translated (or pivoted) end-for-end (or side-for-side) relative to the opening to selectively move the fuse 10 between its two locations. The panel 12 covers or blocks the opening in both locations of the fuse 10. Specifically, as described in the '432 application, the panel 12 is attached to the wall by guides, such as rollers mounted at or near one end of the panel 12 and by links pivotally connected between the wall and the panel 12. As the panel 12 is pivoted end-for-end, the rollers are constrained to move generally along, or coplanarly with, the opening by channels on the wall adjacent to the opening. In this way, substantially all of the end-for-end movement and translation of the panel 12 occurs in front of the wall. Because the panel 12 covers the opening in both locations of the fuse 10, the arrangement of the '432 application is particularly useful in so-called "dead front" or "grounded front" electrical gear. Specifically, in this type of gear energized live parts are maintained behind the wall so that a worker cannot come into contact therewith. When the fuse 10 is accessible in front of the wall, it is electrically disconnected from energized live parts behind the wall and may be safely handled by the worker whose access to the live parts is blocked by the panel 12 and the wall. Reference should be had to the '432 application for further details of the fuse handling arrangement disclosed and claimed therein.

Where the invention of the '432 application is not used, the movable panel 12 may constitute, or be replaced by, a wall of an enclosure, a utility pole, or other support member. Thus, the present invention may be used whether the support member comprises the movable panel 12 of the '432 application or any other movable or stationary support member.

Figure 2A:
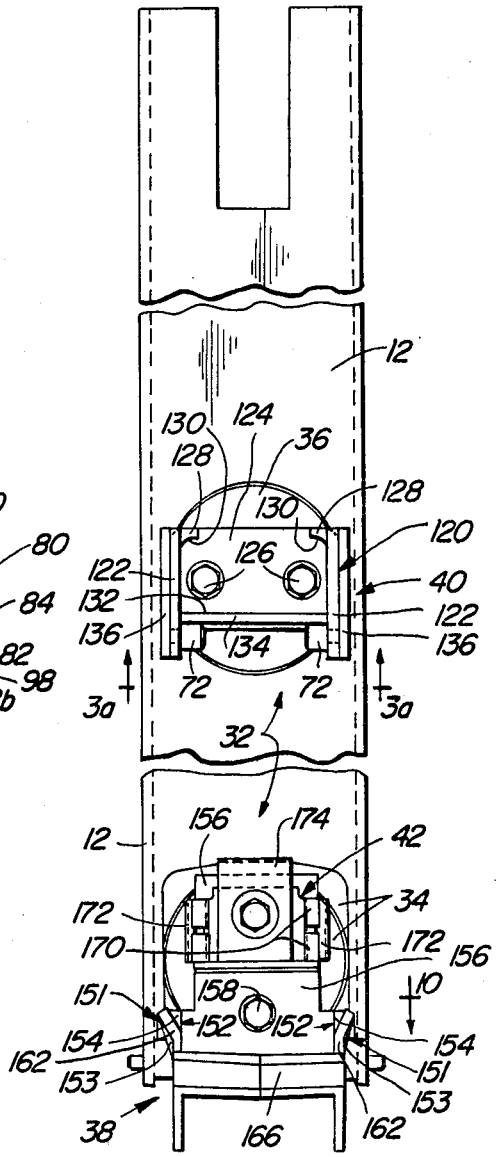
FIG. 2*a* is a front elevation of the mounting shown in FIG. 2.
Figure 2:
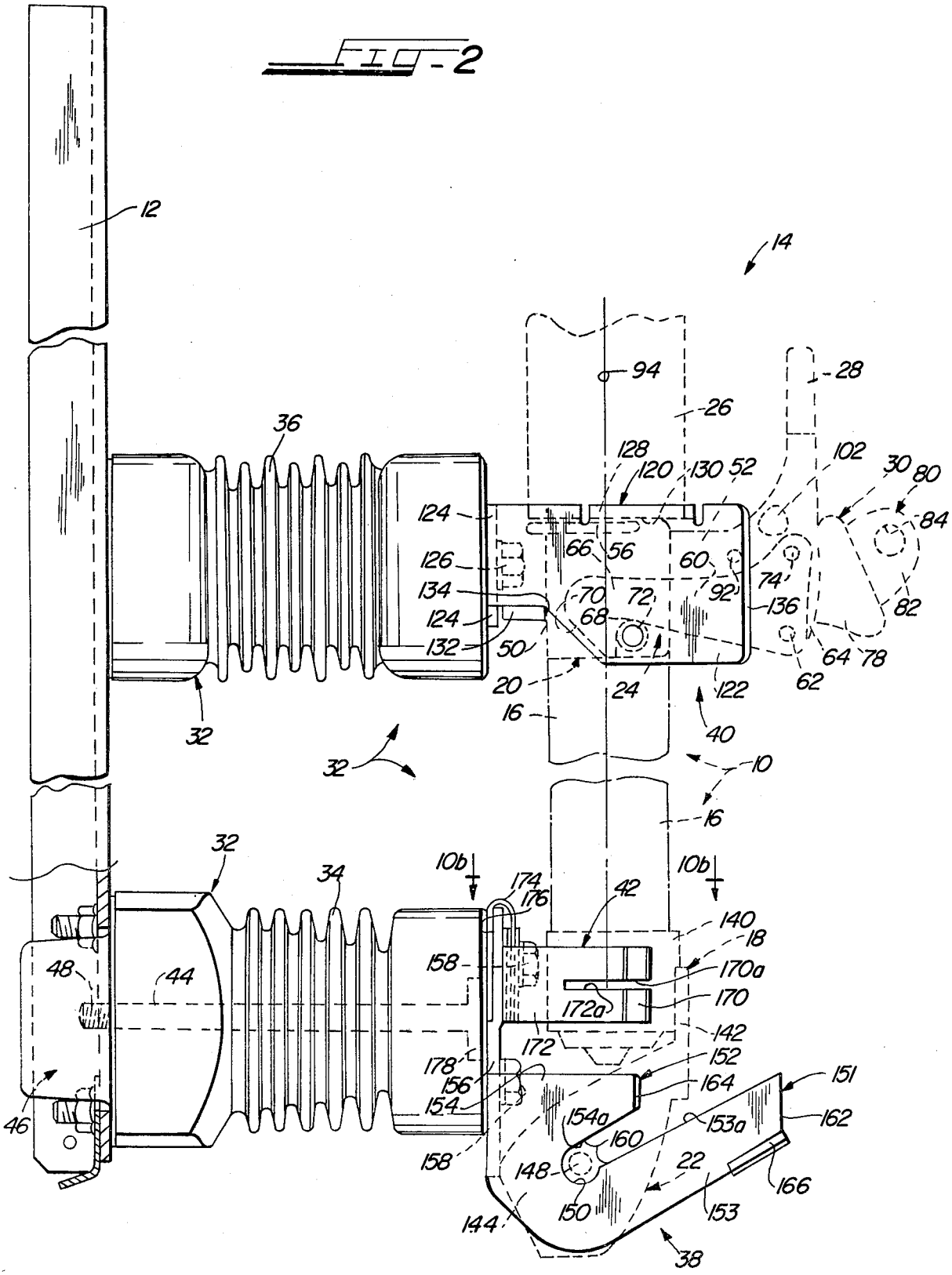
FIG. 2 is a side elvation of a mounting, having an upper and a lower bracket, with which the fuse of FIG. 1, depicted in phantom, may be associated.
Figure 4:
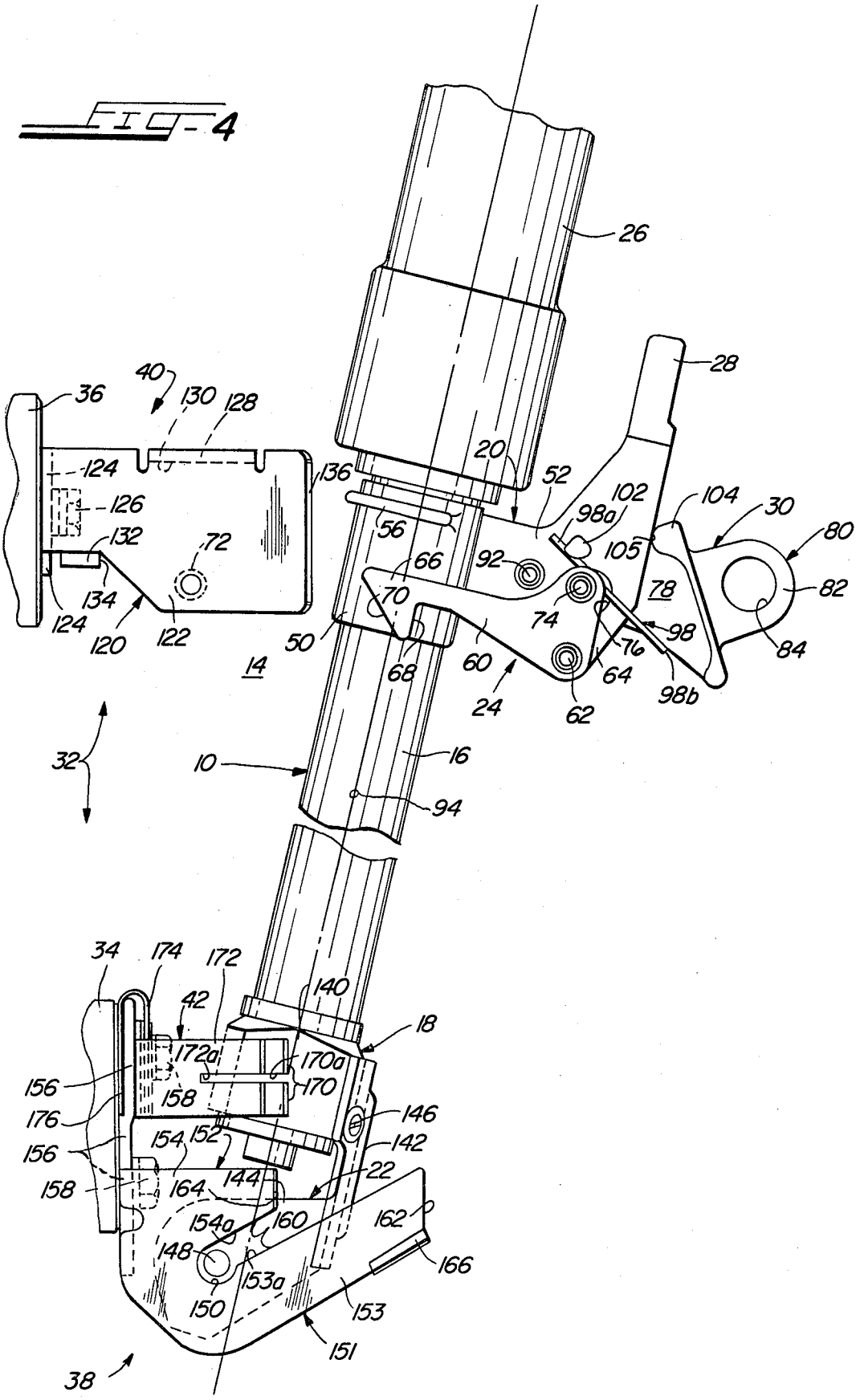
FIG. 4 is a side elevation of the fuse mounting shown in FIGS. 2 and 2*a* and a side elevation of the fuse shown in FIG. 1 as the fuse is being moved from its open to its closed position or from its closed to its open position.
Figure 4A:
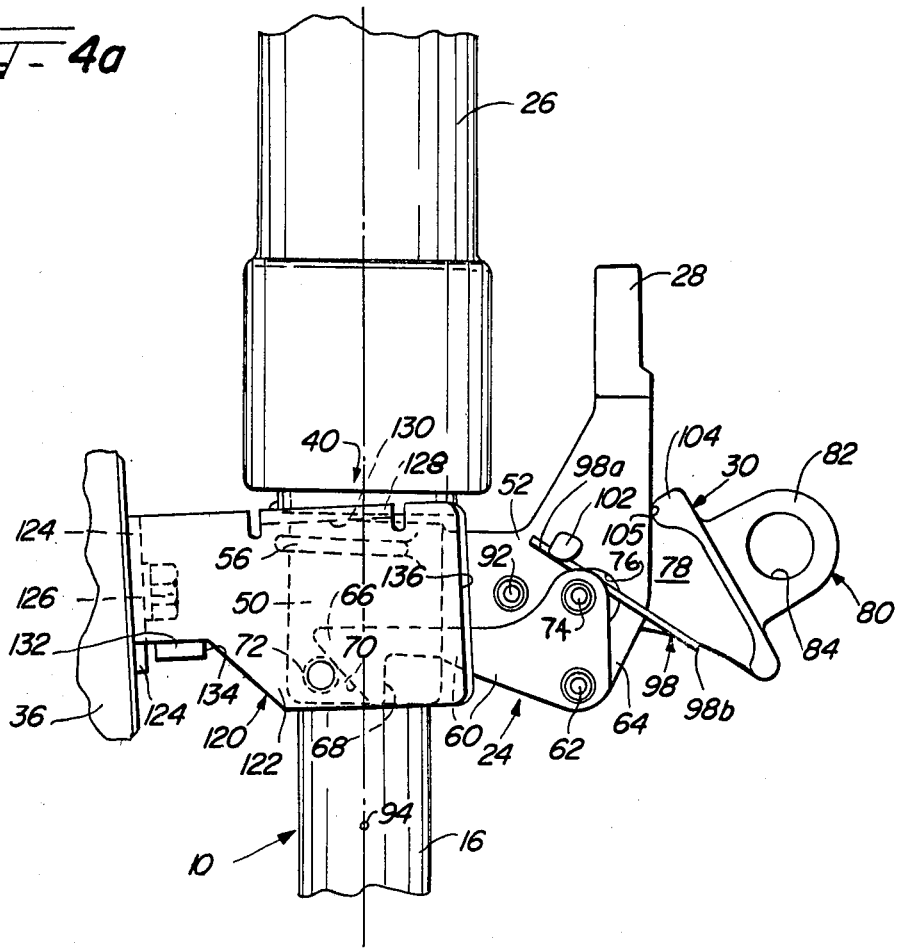
FIG. 4*a* is similar to, and depicts a fragment of, FIG. 4 and shows, in side elevation, a portion of the fuse of FIG. 1 and a portion of the mounting of FIGS. 2 and 2*a* just before the fuse is closed in the mounting.

The improved apparatus according to the present invention is generally depicted by the reference numeral 14 in FIGS. 1, 2 and 4 as used with the fuse 10. The apparatus 14 may be used with other devices such as blades, current-limiting fuses, cutouts, or the like (not shown).

Referring first to FIG. 1, the fuse 10 may include an elongated insulative fuse tube or fuse holer 16. The fuse tube 16 contains current-interrupting facilities (not shown) which respond to overcurrents or short circuits in an electrical circuit (not shown) to which the fuse is connected for interrupting the current in the circuit. Electrical connection of the fuse 10 and of the current-interrupting facilities within the fuse tube 16 to the electrical circuit may be achieved by end fittings 18 and 20 on either end of the fuse tube 16. The end fitting 18 includes a trunnion 22, and the end fitting 20 includes a latching facility 24, both described below. The end fittings 18 and 20 are electrically connected to opposite sides of the current-interrupting facilities within the fuse tube 16. In the case of the fuse 10, the end fittings 18 and 20 may be separate elements from the fuse tube 16 and may be permanently or removably mounted thereto. If the apparatus 14 is used with an electrical device such as a blade, the end fittings may be integral therewith or form a part thereof. If the apparatus 14 is used with a current-limiting fuse, which typically includes axial studs protruding from a housing thereof, the end fittings 18 and 20 may be removably or permanently carried by, or form a part of, the studs.

If the fuse 10 is a power fuse intended for use in an enclosure, an exhaust end of the fuse 10 is preferably in communication with an exhaust control device, generally depicted at 26. In electrical gear which does not incorporate the invention of the '432 application, the fuse 10 would typically be oriented in the enclosure so that the end fitting 20, the exhaust control device 26 (and the exhaust end of the fuse 10) are at the bottom of the fuse 10 and the end fitting 18 is at the top. However, in the '432 application, when the fuse 10 is rendered accessible by manipulation and movement of the panel 12, it is in the upside-down orientation shown in FIGS. 1 and 2. In the '432 application, the positions of the end fittings 18 and 20 and the fuse tube 16 are reversed from that shown in FIG. 1 so that the exhaust control device 26 is at the bottom of the fuse 10 only when the fuse 10 is inaccessibly located within the enclosure. Thus, the apparatus 14 is intended to be used with an electrical device, such as the fuse 10, in whatever orientation the device assumes when it is accessible to a worker for inspection, replacement, or other manipulation. In other words, for purposes of the present invention, the "top" and "bottom" of the fuse 10 or other electrical device and the relative placement of the end fittings 18 and 20 may be arbitrarily chosen, as convenient, depending on the "normal" orientation assumed by the fuse 10 when it is accessible to a worker.

As already noted regarding the '432 application, when the fuse 10 is inaccessible, it has an orientation which is reversed 180° top-for-bottom from that depicted in FIGS. 1 and 2. In this inaccessible location, the end fitting 20, which is electrically connected to one side of the current-interrupting facilities within the fuse tube 16, is electrically continuous with a stationary contact (not shown) behind the wall of the enclosure. To this end, the end fitting 20 may include a stud contact 28 which electrically engages the stationary contact (not shown) when the fuse 10 is inaccessible. Where the invention of the '432 applicatiion is not used, the stud contact 28 may take some other configuration or may be eliminated.

The end fitting 20 also includes an assembly, such as the pull-ring assembly shown generally at 30, which, in the prior art, is manipulable by a "hot stick" to open or close the fuse 10 in a mounting, such as that generally indicated by the reference numeral 32 in FIGS. 2, 2*a*, and 4. The pull-ring assembly 30 is also manipulable in the prior art by a tool such as a GRAPPLER which simultaneously supports the fuse tube 16 (or other portion of the fuse 10) to remove the fuse 10 from or to insert the fuse 10 into the mounting 32. Although not common in the prior art, for reasons discussed earlier, the pull-ring assembly 30 is theoretically graspable by a tool such as a "shotgun stick".

As described more fully below, insertion of the fuse 10 in the mounting 32 and closing of the fuse 10 may be achieved by the application of a pushing force (from right-to-left in FIGS. 2 and 4) to the assembly 30. Opening of the fuse 10 in the mounting 32 and removal of the fuse 10 therefrom may be achieved by applying a pulling force (from left-to-right in FIGS. 2 and 4) to the assembly 30. The pushing and pulling force may conveniently be applied by a worker through the use of an appropriate single tool, which also permits the fuse 10 to be inserted into and removed from the mounting 32.

The improved apparatus 14 of the present invention primarily constitutes elements carried by the end fitting 20 and its latching facility 24, as described in greater detail below. The upper portion of the fuse mounting 32 depicted in FIGS. 2 and *2a*, as well as the lower end fitting 18 (FIG. 1) and the lower portion of the mounting 32 shown in FIGS. 2 and *2a* (and the alternative thereof shown in FIGS. 9–*9c*) are preferred, although they are not crucial to the present invention in its broadest aspects.

Referring now to FIGS. 2 and *2a*, the fuse mounting 32 may be seen to include a support member, such as the movable panel 12, and a pair of spaced insulators 34 and 36 mounted to a surface of the panel 12 in any convenient fashion. The insulator 34 mounts a bracket 38 in which the trunnion 22 may be inserted and from which the trunnion 22 may be removed by appropriate manipulation of a tool grasping the assembly 30. The details of the preferred forms of the bracket 38 and its cooperation with the trunnion 22 are described in greater detail below. Suffice it here to say that the bracket 38, regardless of its configuration, permits insertion into and removal therefrom of the trunnion 22 when the fuse 10 assumes a selected orientation relative to the mounting 32, and, with the trunnion 22 inserted in the bracket 38, permits the fuse 10 to be rotated clockwise (opened) or counterclockwise (closed) in the mounting 32, as viewed in FIG. 2.

The insulator 36 mounts a bracket 40 which cooperates with the latching facility 24 on the end fitting 20 to selectively maintain the fuse 10 closed in the mounting 32, as depicted in FIG. 2, and permit the fuse to be rotated in a clockwise direction, or opened, on the trunnion 22 in the bracket 38, as depicted in FIG. 4. In the closed position of the fuse 10 shown in FIG. 2, both end fittings 18 and 20 are mechanically engaged with their respective brackets 38 and 40, which may, as shown, be adjacent to or partially surround their respective end fittings 18 and 20 and the opposed ends of the fuse 10 on which the end fittings 18 and 20 are carried. The same relationship of the brackets 38 and 40 to the end fittings 18 and 20 obtain if the device is a blade or a current-limiting fuse. The fuse 10 may be opened by rotating in a clockwise direction (going from FIG. 2 to FIG. 4) until the end fitting 20 is rotated away, and is remote, from the upper bracket 40, following which the fuse 10 may be removed from the mounting 32 by removing the trunnion 22 from the bracket 38. Closing and opening movement of the fuse 10, as well as insertion of the trunnion 22 into the bracket 38 and removal of the trunnion 22 from the bracket 38, may be conveniently achieved, according to the present invention, by appropriate manipulation of a single tool, such as a "shotgun stick" which grasps the assembly 30.

Where the improved apparatus 14 of the present invention is used with the invention of the '432 application, electrical connection to the end of the fuse 10 which is remote from the end fitting 20 and its stud contact 28 must be provided for when the fuse 10 is inaccessible. As described in greater detail in the '432 application, such electrical connection may be provided by means of facilities included with the insulator 34. Specifically, and referring to FIG. 2, the insulator 34 may serve as a mechanical support for both the bracket 38 and a contact assembly 42 carried by or forming a part of the bracket 38. The contact assembly 42 engages a portion of the end fitting 18 when the fuse 10 is closed, as depicted in FIG. 2. The contact assembly 42 is electrically connected to a conductor 44 which passes through the insulator 34 and terminates within a bushing well 46 of standard configuration formed at the end of the insulator 34 remote from the bracket 38. The bushing well 46, which is preferably integral with the insulator 34, passes through the panel 12 as shown. A bushing-well insert (not shown) may be inserted into the bushing well 46 and a conductive portion thereof is attached to the conductor 44 by threading it onto a threaded portion 48 of the conductor 44. After appropriate association of the bushing-well insert with the bushing well 46, a standard elbow (not shown) of the loadbreak or non-loadbreak variety may be selectively connected to or disconnected from the bushing-well insert by a tool, such as a "shotgun stick," when the panel 12 is in a position rendering the fuse 10 inaccessible, as described in the '432 application. Thus, the fuse 10 may be opened and closed in the mounting 32 by the same tool used to manipulate the elbow. The current-interrupting facilities within the fuse tube 16 are, accordingly, electrically connectable to an electrical circuit via the stud contact 28 on the end fitting 20 and the conductive rod 44 having the bushing-well insert (not shown) and elbow (not shown) associated therewith.

Although the apparatus 14 of the present invention finds particular use with the invention of the '432 application, it need not necessarily be so used. Since the apparatus 14 renders more convenient and simple the opening, closing and handling of the fuse 10 or other electrical device than heretofore provided, it may be used in any type of electrical gear wherein removable electrical devices are present.

End Fitting 20, Latching Facility 24, and Assembly 30

Referring now to FIGS. 1, 4, *4a*, 5—*5c*, *6a*, *6b*, *7a*, *7b*, and 8, there are shown in detail the end fitting 20, the latching facility 24, and the assembly 30.

Figure 5:
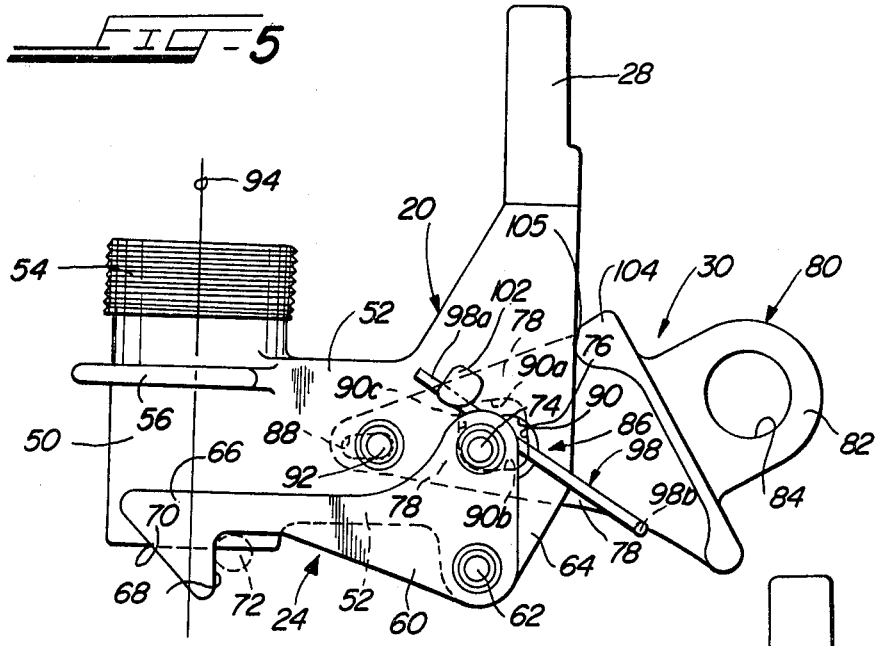
FIG. 5 is a side elevation of the upper end fitting of the fuse shown in FIGS. 1, 2, 4 and 4*a* and depicting in greater detail the normal condition of a latching facility thereon according to the present invention.

With particular reference to FIGS. 5—*5c*, the end fitting 20 may include a ferrule, ring or cap 50 having an extending leg 52, which is attached to or formed integrally with the ferrule 50. The end fitting 20 may be permanently or removably attached to the fuse tube 16 in any convenient manner, such as by the use of pins, adhesives, or the invention shown in commonly-assigned U.S. Pat. No. 4,158,830. In preferred embodiments of the present invention, where the end fitting 20 is mounted to the fuse tube 16 at the exhaust end of the fuse 10, the ferrule 50 may include a threaded collar 54 to which the exhaust-control device 26 is affixed for communication with the exhaust end of the fuse 10. If the improved apparatus 14 is not use with the invention of the '432 application (e.g., the panel 12 is not movable) and the end of the fuse tube 16 to which the end fitting 20 is attached is the non-exhaust end of the fuse 10, the threaded collar 54 may form a part of the end fitting 18. Further, if the improved apparatus 14 is used with an electrical device other than the fuse 10, such as a blade or current-limiting fuse, there may be no need to use the exhaust-control device 26, and the threaded collar 54 may be absent from both end fittings 18 and 20.

The ferrule 50 may include a flange 56 formed partially therearound (see FIGS. 5 and *5a*) which serves a guiding function during closing rotation of the fuse 10 on its trunnion 22 in the bracket 38, as described below. If the present invention is used with the invention of the '432 application, preferably attached to or formed integrally with the extending leg 52 is the stud contact 28, which may be otherwise eliminated or modified.

The latching facility 24 is carried by the end fitting 20. The latching facility 24 preferably includes pair of levers 60 mounted on opposed ends of a pivot pin 62 or the like which is pivotally held in a pair of spaced ears 64 (see FIG. 5*a*) depending from the extending leg 52. The free end 66 of each lever 60 remote from the pivot pin 62 may have a hook or hook-like feature which includes an engaging surface 68 and a cam surface 70. The function of each surface 68 is to engage a stud or similar member 72 (shown in phantom in FIG. 5; see FIG. 2) mounted to the bracket 48, as described below. When the fuse 10 is rotated by a pushing force on the assembly 30 to the position depicted in FIG. 2, the levers 60 assume a first normal position, whereat the surfaces 68 engage the studs 72 to hold the fuse 10 closed. In order to open the fuse 10, the surfaces 68 must be disengaged from the studs 72. Such disengagement is achieved by pivoting the levers 60 clockwise out of their first position and to a second position (FIG. 5*c*). When the fuse 10 is moved from the open position (clockwise of the position shown in FIG. 4) to the closed position (FIG. 2), the hooks 66 on the levers 60 bypass the studs 72 due to the function of the cam surfaces 70. Specifically, and referring to FIG. 4*a*, assuming that the fuse 10 is being closed by a pushing force on the assembly 30 to rotate in a counterclockwise direction, sufficient closing movement of the fuse 10 brings the cam surfaces 70 into abutment with their studs 72. Continued counterclockwise movement of the fuse 10 causes this abutment to cam the levers 60 out of their first position in a clockwise direction (as viewed in FIG. 4*a*), moving the levers 60 upwardly to their second position until the engaging surfaces 68 are in a position whereat they may engage their studs 72 and hold the fuse 10 closed. As described subsequently, the levers 60 are biased to the first normal position depicted in FIG. 5 so that, after the engaging surfaces 68 are to the left of the studs 72, as viewed in FIGS. 4*a* and 5, the levers 60 are moved downwardly and the surfaces 68 engage the studs 72, holding the fuse 10 closed.

As should be clear, only one lever 60, or more than the two levers 60 depicted, may be used, as necessary. Further, the configuration, location, and direction of rotation of the levers 60, the leg 52, the ears 64 and the free ends 66 of the levers 60, including the surfaces 68 and 70, may be altered as suitable.

The ends of the levers 60 remote from the free ends 66 thereof may have the general triangular shape depicted or any other convenient shape. Interconnecting the levers 60 immediately above the pivot pin 62 (as the levers 60 are viewed in the normal position shown in FIGS. 2 and 5) is a pin or bar 74. Where, as shown, the levers 60 are on opposite sides of the leg 52, the pin or bar 74 may pass through an opening 76 formed through the leg 52 for free transverse motion therewith. Movement of the pin 74 generally to the right, as viewed in FIG. 5, rotates the levers 60 clockwise on the pivot pin 62 to move the levers 60 and their free ends 66 clockwise, thus raising or lifting the engaging surfaces 68. Accordingly, such general rightward movement of the pin 74 when the surfaces 68 engaging the studs 72 (the fuse 10 being held closed thereby) disengages the surfaces 68 from the studs 72 and permits the fuse 10 to be rotated clockwise, as viewed in FIG. 2, for opening thereof.

If a single lever 60 is used, the pin 74 may have one end mounted thereto and the other end free. Moreover, the single lever 60 may merely be located on either side of the extending leg 52. Further, the pin 74 may pass through the opening 76 or may be located away from the extending leg 52 (e.g., to the right thereof as viewed in FIG. 5).

The relative positions of the pivot pin 62 and the pin 74 should be noted. Specifically, in the normal position of the levers 60 depicted in FIGS. 2 and 5, the pin 74 lies directly above the pivot pin 62. As a consequence, generally vertically directed forces applied to the pin 74 do not tend to move or rotate the pin 74 about the pivot point of the levers 60 provided by the pivot pin 62, and, therefore, these generally vertical forces cannot rotate the levers 60 or the surfaces 68.

Figure 8:
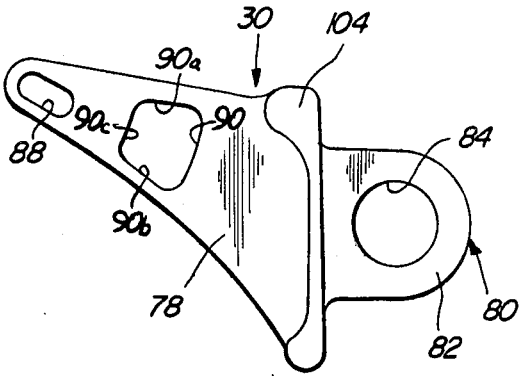
FIG. 8 is a side elevation of a pull-ring assembly forming a portion of the latching facility depicted in FIG. 5.

Referring to FIGS. 5—5*c* and 8, the assembly 30 includes an arm 78. Attached to or formed integrally with the arm 78 is a pull-ring 80 which includes a tab 82 having an aperture 84 therethrough. The pull-ring 80 may be grasped and manipulated by a tool, such as a "shotgun stick," by inserting a portion of the tool through the aperture 84 and grasping the wall thereof and/or the tab 82 for manipulation and movement of the fuse 10. A tool other than a "shotgun stick," such as a standard "hot stick" with a special fitting thereon, may be used to grasp the assembly 30, in which event the latter may assume a configuration (especially regarding the tab 82 and the aperture 84) different from that shown. As used herein, a "shotgun stick" is any tool capable of grasping the assembly 30 regardless of the form taken by either. Further, the term "hot stick" refers to any tool capable of engaging (but not grasping) the aperture 84 of the assembly 30.

The extending leg 52 of the end fitting 20 may include an elongated passageway 86 (FIGS. 5 and 5*a*) in which a portion of the arm 78 is located and which, at the lower right (in FIG. 5) of the extending leg 52, defines the ears 64. The arm 78 contains an elongated slot 88 and an enlarged hole 90 therethrough. Extending between and held in the walls of the passageway 86 is a pivot shaft 92. The pivot shaft 92 passes through the slot 88. The pin 74 passes through the hole 90, after passing through the openings 76 on either side of the extending leg 52, and is freely movable therein. As shown in the FIGURES, the hole 90 is within the passageway 86. If desired, the hole 90 may be located to the right (in FIG. 5) of the leg 52 if the pin 74 is similarly located.

The slot 88 is preferably elongated in a direction generally transverse to the fuse 10. In the specific embodiments shon in the FIGURES, the elongation of the slot 88 is generally transverse to the axis 94 of the fuse tube 16, which axis 94 generally coincides with the axis 94 of the ferrule 50 which is mounted thereto, although other directions of elongation are contemplated. Because of the elongation of the slot 88, the arm 78 may be reciprocated generally transversely of the fuse 10, and in the depicted embodiments, toward and away from the axis 94 on the pivot shaft 92. The arm 78 may also pivot on the pivot shaft 92, regardless of the reciprocating position the slot 88 assumes relative to the pivot shaft 92 due to reciprocation of the arm 78. Also, the arm 78 may be reciprocated generally transversely of the fuse 10 on the pivot shaft 92, regardless of the pivotal orientation of the slot 88 relative to the pivot shaft 92. Pivoting of the arm 78 on the pivot shaft 92, which preferably occurs in a plane generally parallel to the fuse 10 and to the line of reciprocation of the arm 78, merely shifts the line of reciprocation of the arm 78 slightly up or down so that it remains generally transverse of the fuse 10 and of the axis 94 thereof. Abutment between the pivot shaft 92 and the ends of the slot 88 sets the limits of the reciprocating movement of the arm 78 generally transversely of the fuse 10.

The hole 90 may have a general trapezoidal shape and includes a first upper wall 90*a* and a second, opposed lower wall 90*b*, both of which extend generally transversely of the fuse 10 and its axis 94. The upper and lower walls 90*a* and 90*b* of the hole 90 are interconnected by a third wall 90*c* which extends in a direction generally parallel to or along the fuse 10 and its axis 94. Because of the enlargement of the hole 90 between the upper and the lower walls 90*a* and 90*b*, the arm 78 may be pivoted on the pivot shaft 92 between limits which are set by the abutment of the walls 90*a* and 90*b* with the pin 74. Abutment of the walls 90*a* and 90*b* with the pin 74 does not cause rotation of the lever 60 out of the normal position shown in FIG. 5 because of the positional relationship of the pivot point of the lever 60 (pivot pin 62) and the pin 74, as already discussed.

The assembly 30 is shown in its normal reciprocating location in FIG. 5. If the assembly 30 is moved to the right out of this normal location so that the arm 78 reciprocates rightwardly, the wall 90*c* of the hole 90, which normally abuts and bears against the pin 74, moves the pin 74 generally rightwardly relative to the pivot pin 62. Such general rightward movement of the pin 74 rotates the lever 60 in a clockwise direction. Accordingly, rightward movement of the assembly 30 causes the surfaces 68 to disengage the studs 72 and permits the fuse 10 to be opened and removed from the bracket mounting 32.

Preferably, the wall 90*c* has the shape of the arc of a circle having its center at the center of the pivot shaft 92 when the pivot shaft 92 abuts the right end (as seen in FIG. 5) of the slot 88. This shape ensures that the arm 78 can freely pivot and, in doing so, that the wall 90*c* moves under the pin 74 without imparting any motion thereto. This shape also ensures that in any pivotal orientation of the arm 78 while the arm 78 remains in its normal reciprocating location, there is little or no clearance between the wall 90*c* and the pin 74 so that rightward reciprocation of the assembly 30 effects nearly instantaneous pivoting of the levers 60, with little or no lost motion.

The pivot shaft 92 and the pin 94 preferably lie on a line which is generally normal to the line defined by the pin 74 and the pivot point (the pivot pin 62) of the levers 60. This ensures that rightward reciprocation (in FIG. 5) of the assembly 30, regardless of its pivotal orientation, rotates the pin 74 about the pivot pin 62 to pivot the levers 60.

As should be clear from the above description, the slot 88 and the hole 90 need not be formed through the arm 78. For example, if only one lever 60 is present, the slot 88 and the hole 90 may be replaced by "blind" versions thereof which need be only sufficiently deep to ensure that the pivot shaft 92 (now having a free end) is retained in the blind slot and that the pin 74 (now also having a free end) is retained in the blind hole. Further, the slot 88 may be eliminated from the arm 78 and corresponding slots may be formed in the leg 52 to hold therein a pivot shaft now attached to the arm 78. By a similar change, the arm 78 may hold a pin equivalent to the pin 74, while the hole 90 is eliminated therefrom with corresponding holes being formed in the levers 60. The slots in the leg 52 replacing the slot 88, and the hole in the levers 60 replacing the hole 90 would be shifted rightwardly from the locations shown in FIG. 5.

Figure 5A:
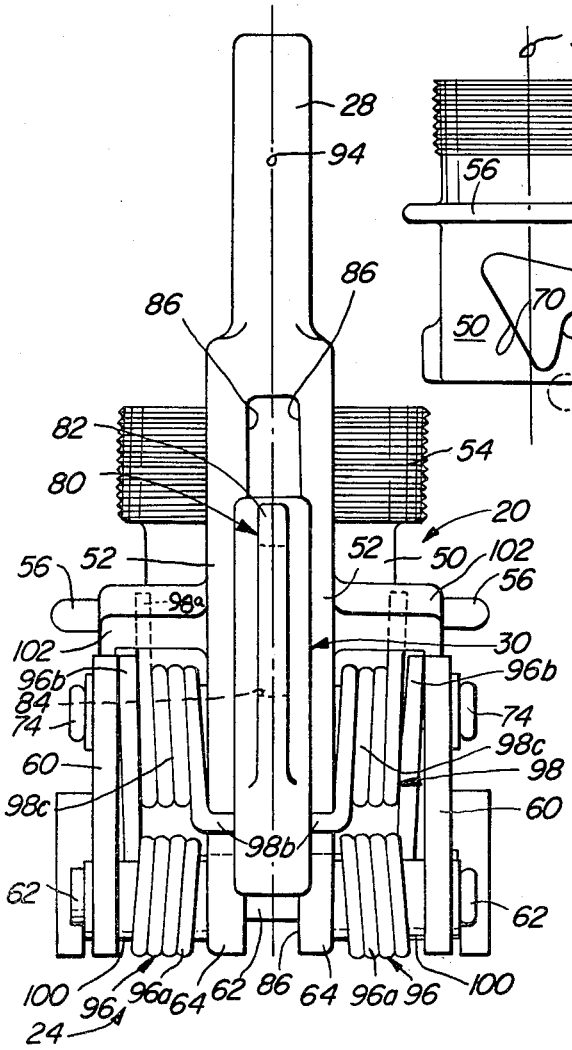
FIG. 5*a* is a front elevation of the latching facility shown in FIG. 5.
Figure 5C:
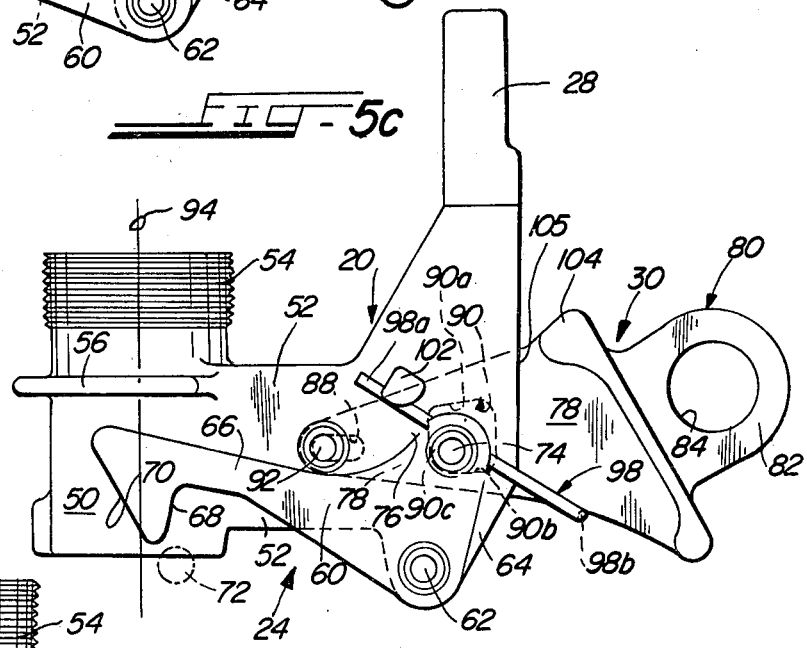
FIG. 5*c* is a side elevation similar to FIG. 5 in which the latching facility has been operated to permit opening of the fuse shown in FIG. 1 in the mounting depicted in FIGS. 2 and 2*a;*
Figure 5B:
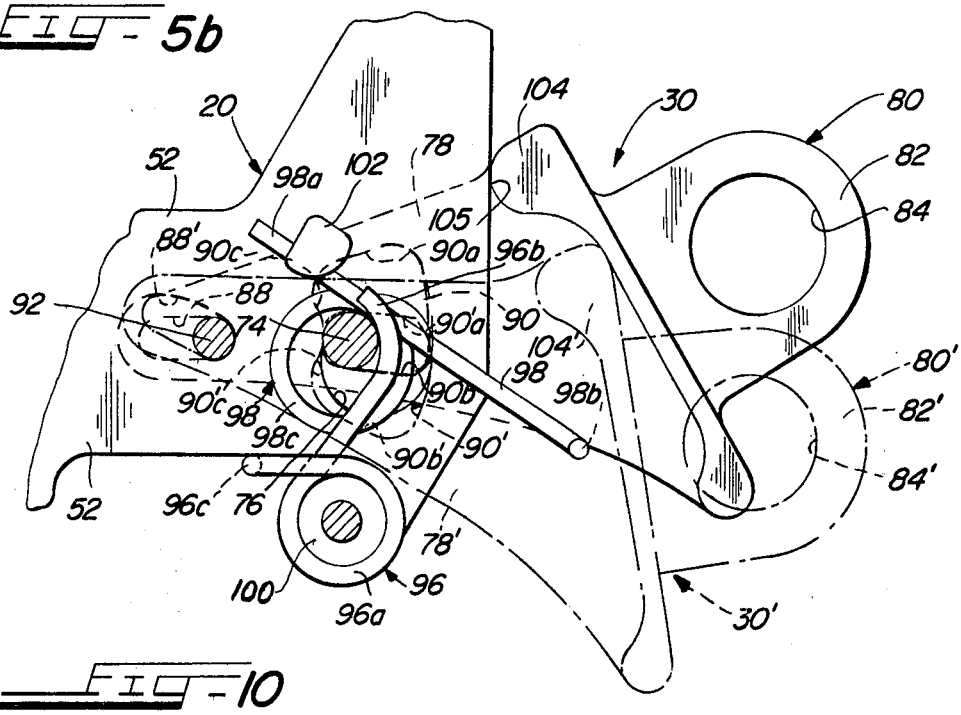
FIG. 5*b* is a side elevation of a portion of the latching facility shown in FIG. 5 with certain parts removed to illustrate in greater detail the construction and operation thereof.

Referring now especially to FIGS. 5*a* and 5*b*, two biasing springs 96 and 98 are depicted. Only a free end 98*a* and an interconnecting bridge 98*b* of the spring 98 are visible in FIGS. 1, 4, 4*a*, 5, and 5*c*. While the use of only the two biasing springs 96 and 98 is preferred, a greater or lesser number of springs having different configurations and locations may be used, as will be clear below.

The biasing spring 96 may have two main coiled portions 96*a* (see FIG. 5*a*) surrounding outwardly directed shoulders 100 formed on the depending ears 64 of the extending leg 52. The pivot pin 62 may pass through the shoulders 100. Referring to FIG. 5*b* (in which the levers 60 are not shown so that the springs 96 and 98 may be clearly observed), it may be seen that free ends 96*b* of the coils 96*a* act at two points against the right side of the pin 74 to bias it toward the left. A bridge 96*c* interconnecting the coils 96*a* passes under the extending leg 52 and acts thereagainst for biasing of the pin 74 leftwardly.

The spring 98 may have two coiled portions 98*c* loosely surrounding the pin 74 so as not to interfere with movement thereof. The free ends 98*a* of the coils 98*c* act against reaction members 102 attached to or formed integrally with the extending leg 52. The bridge 98*b* of the spring 98 between the coils 98*c* bears against the underside of the arm 78.

The spring 96 is effective to bias the pin 74 to the left and, accordingly, to bias the levers 60 counterclockwise so that the surfaces 68 are normally located to engage the studs 72, both as viewed in FIG. 5. During closing movement (counterclockwise rotation) of the fuse 10, as the cam surfaces 70 engage the studs 72 (FIG. 4*a*), the levers 60 are cammed upwardly (clockwise) against the bias of the spring 96 on the pin 74 until the surfaces 68 are able to engage the studs 72. Normally, and as already noted, the pin 74 bears against the third wall 90*c* of the hole 90 and, accordingly, the spring 96 is also normally effective to bias the assembly 30 to the left, as viewed in FIGS. 5 and 5*b*. The only time this leftward biasing force is not applied on the assembly 30 by the spring 96 is when the levers 60 are pivoted in a clockwise direction on the pivot pin 62 by something other than rightward movement of the assembly 30 as, for example, when the levers 60 are so pivoted by abutment between the camming surfaces 70 and the studs 72. At all other times, the spring 96 biases both the levers 60 counterclockwise and the arm 78 leftwardly. If it is deemed necessary to spring bias the arm 78 to the left at all times (an unnecessary expedient since the pushing force on the assembly 30 will hold the arm 78 to the left at the only time the spring 96 does not do so), additional steps can be taken. For example, a compression spring may be placed in the slot 88 to act between the left end thereof and the pivot shaft 92.

The spring 98 is effective to bias the arm 78 to a predetermined normal pivotal orientation, depicted in FIGS. 5 and 5*c* as an uppermost orientation, whereat the pin 74 abuts the lower wall 90*b* of the hole 90. The uppermost limit of pivoting by the arm 78 on the shaft 92 may also, if desired, be set by lobes 104 formed at the junction of the arm 78 and the tab 82. Of course, the spring 98 may set some other normal pivotal orientation for the arm 78 and the assembly 30. Preferably, this normal pivotal orientation is selected so that when the fuse 10 is out of the mounting 32 and it is manipulated by a tool grasping the tab 82 and/or the aperture 84, and the tool is held by a worker in a comfortable position relative to the mounting 32, the trunnion 22 is angularly presented for convenient, easy insertion into the bracket 38. Stated differently, the spring 98 may set a normal pivotal orientation for the arm 78 so that when a tool, such as a "shotgun stick," grasping at one end of the assembly 30 is comfortably held at its other end by a worker, the trunnion 22 (and the fuse 10) is angularly oriented (as described below) to facilitate insertion of the trunnion 22 into the bracket 38. The strength of the spring 98 may be selected to maintain the normal pivotal orientation of the arm 78 (and of the tool grasping it) relative to the axis 94 of the fuse 10, by giving due consideration to the weight and center of gravity of the fuse 10 and its end fittings 20 and 22. In the prior art, the grasping of a pull-ring with a "shotgun stick" might permit the fuse 10 to be lifted and inserted into the bracket 38, but unless grasping is released or loosened (or another, non-grasping tool is used) when the fuse 10 is closed, either binding occurs or the pull-ring is rotated, rendering the fuse 10 unable to be latched closed. Both shortcomings of the prior art result from the decrease in the interior angle between the axis 94 of the fuse 10 and the tool which necessarily occurs as the fuse 10 is rotated counterclockwise. That is interior angle between the tool and the fuse 10 (and, therefore, the pivotal orientation of the arm 78) may, in the present invention, freely change after insertion of the fuse 10 in the mounting 32 as the pushing force is applied to the assembly 30 cannot, as can in prior art apparatus, prevent engagement of the surfaces 68 and the studs 72. This follows from the fact that pivoting of the arm 78 can occur independently of, and has no effect on, movement of the levers 60. As should be obvious, the strength of the spring 98 may be selected to maintain the normal pivotal orientation of the arm 78 against the weight of the fuse 10, while permitting rotation of the arm 78 as the pushing force is applied thereto to close the fuse 10.

The use of the two springs 96 and 98 (which could be replaced with a single spring, appropriately configured) complements the use of only two moving members, the lever 60 and the arm 78, to render the latching facility 24 simple and inexpensive to manufacture and positive in operation.

The arm 78 may be capable of pivoting on the pivot shaft 92 any desired amount. In the embodiment depicted in FIGS. 5 and 5*b*, the amount of such pivoting is approximately 20°. The pivotability of the assembly 30 by the pivoting of the arm 78 on the pivot shaft 92 provides the ability to angularly adjust a tool, such as a "shotgun stick" or the like, grasping the pull-ring 80 to a convenient angle of attack before the tool is pulled or pushed to open or close the fuse 10.

The ability of the assembly 30 to be angularly adjusted to provide a convenient angle of attack by a tool grasping it before the tool is pulled or pushed, and also the ability of the interior angle between the tool and the fuse 10 as the fuse 10 is closed, are depicted in FIG. 5*b*. In FIG. 5*b*, the assembly 30 is shown in the predetermined, uppermost orientation to which it is biased by the spring 98. As already noted, this normal pivotal orientation of the assembly 30 may be determined by abutment between the pin 74 and the lower wall 90*b* of the hole 90, by engagement between the node 104 and back surface 105 of the extending leg 52, by both of these, or simply by proper selection of the strength of the spring 98. After the assembly 30 is grasped or merely engaged with a tool, if its pivotal orientation represents a convenient angle of attack for the worker, a rightward pulling force may then be applied to the tool, moving the assembly 30 rightwardly. As previously described, this action moves the pin 74 rightwardly against the bias of the spring 96 to rotate the levers 60 in a clockwise direction, as shown in FIG. 5*c*. If the fuse 10 is closed in the mounting 32, the surfaces 68 are moved out of engagement with the studs 72. Continuation of the pulling force on the tool opens the fuse 10 by rotating it clockwise (as viewed in FIG. 4) and ultimately results in removal of the trunnion 22 from the bracket 38. These actions—unlatching, opening, and removal—can be conveniently effected serially by a more or less continuous pulling motion on the tool, a result not as conveniently permitted by prior art devices requiring a pull ring to be pivoted in order to unlatch the fuse.

Similarly, the assembly 30 may be rotated to the lowermost position (or to any intermediate position) depicted in phantom at 30' in FIG. 5*b* by a tool grasping or merely engaging the pull ring 80, if this is necessary to provide a more convenient angle of attack for the tool before the rightward pulling force is applied thereby. Regardless of the downward pivoting of the pull-ring assembly 30 to the position shown at 30' in FIG. 5*b*, the action of the spring 96 maintains the pin 74 in contact with the third wall 90*c* of the hole (now located at 90*c'*) without moving the pin 74 rightwardly and, therefore, without affecting the position of the levers 60. In the lowermost position of the assembly 30 as shown at 30' in FIG. 5*b*, the elements 78, 80, 82, 84, 90, 90*a*, 90*b*, 90*c*, and 104 are all designated by primes. Angles other than 20° for pivoting of the pull-ring assembly 30 may obviously be provided. If the downward pivoting of the pull-ring assembly 30 continues until the pin 74 is abutted by the first wall 90*a* of the hole 90 (shown at 90*a'* in FIG. 5), as previously discussed, this abutment has no effect on the position of the pin 74, because of its relative positional relationship to the pivot pin 62, and does not effect disengagement of the studs 72 by the surfaces 68. Following pivoting of the pull-ring assembly 30 to its lowermost or to any intermediate position, as convenient, the tool grasping the pull-ring 80 may be pulled to the right, moving the pin 74 rightwardly and rotating the levers 60 clockwise to disengage the surfaces 68 from the studs 72. Of course, the pivotal orientation of the assembly 30 may also freely change, more or less automatically, as, or because, the pulling force is applied thereto. Once again, continued rightward pulling on the tool is effective to disengage the surfaces 68 from the studs 72, to open the fuse 10 by rotating it clockwise, and to remove the trunnion 22 from the bracket 38. As should be obvious from FIG. 5*b*, a rightward pulling action on a tool engaging the pull-ring 80 may effect the same convenient and easy to achieve unlatching of the fuse 10, opening of the fuse 10, and removal of the trunnion 22 from the bracket 38 at any pivotal orientation of the assembly 30.

Prior art fuse mounting arrangements typically require pivoting or rotational movement of a pull ring by a tool in order to unlatch the fuse from a mounting. Following this unlatching, the prior art arrangements typically require repositioning of the tool or the use of a second tool to open the fuse and/or to remove the fuse from the mounting. Because pivoting of the pull ring unlatches the fuse in such prior art arrangements, either (1) the tool grasps the pull-ring and is not adjustable to a convenient angle of attack before unlatching or (2) the tool is adjustable because it only engages the pull-ring but does not grasp the pull-ring. Condition (1) forces the worker to unlatch the fuse at a possibly inconvenient angle of attack, and because opening of the fuse is achieved by rotation thereof, renders such opening and/or removal of the fuse from the mounting inconvenient or impossible without repositioning of the tool or requiring the use of a second tool following such unlatching. Condition (2) requires repositioning of the tool or manipulation of the tool to grasp the pull-ring following unlatching for either opening thereof or removal thereof from the mounting or both.

Since the improved apparatus 14 of the present invention permits unlatching of the fuse 10 due to a pulling action on the assembly 30 by a tool which is preadjustable or automatically movable to a convenient angle of attack, there is no need to reposition the tool, nor to use a second tool to effect opening of the fuse 10 and removal of the trunnion 22 from the bracket 38 following unlatching of the fuse 10. Rather, unlatching of the fuse 10, opening of the fuse 10, and removal of the trunnion 22 from the bracket 38 can be achieved serially by means of a single pulling action on the tool, whether the tool grasps or merely engages the pull-ring 80.

Re-insertion of the fuse 10 into the mounting 32 may similarly be achieved by a single continuous manipulation of the fuse 10. This insertion may be achieved, according to the present invention, by a tool grasping the pull-ring assembly 30, this grasping permitting convenient transportation and lifting of the fuse 10. Specifically, the tool grasping the assembly 30 manipulates the fuse 10 to insert the trunnion 22 into the bracket 38 (described earlier), following which a single pushing action on the tool moves the fuse 10 counterclockwise in a closing movement until the cam surfaces 70 of the levers 60 engage the studs 72 from the right, as viewed in FIG. 4*a*. Continued pushing on the assembly 30 by the tool grasping it causes the levers 60 to bypass the studs 72, as previously described, until the surfaces 68 are in a position to engage the studs 72 under the biasing action of the spring 96 on the pin 74. The ability of the arm 78 to pivot without affecting the position of the levers 60 and the action of the spring 98 on the arm 78 coact to render convenient and easy insertion of the trunnion 22 into the bracket 38 and closure of the fuse 10 without compromising the ability of the surfaces 68 to engage the studs 72, as already described. In the prior art, grasping a pull-ring with a "shotgun stick" or the like, while theoretically possible, would generally only permit the fuse to be inserted in the mounting. Unless the grasping were released or another non-grasping tool were used, closing of the fuse would rotate the pull-ring, preventing the fuse from being latched closed. The assembly 30 of this invention not only permits the pull-ring 80 to be grasped so that the trunnion 22 is easily inserted in the bracket 38, but thereafter permits closing and latching of the fuse 10 regardless of the decrease in the interior angle between the tool and the axis 94 (which rotates the arm 78 without affecting the levers 60).

Figure 6A:
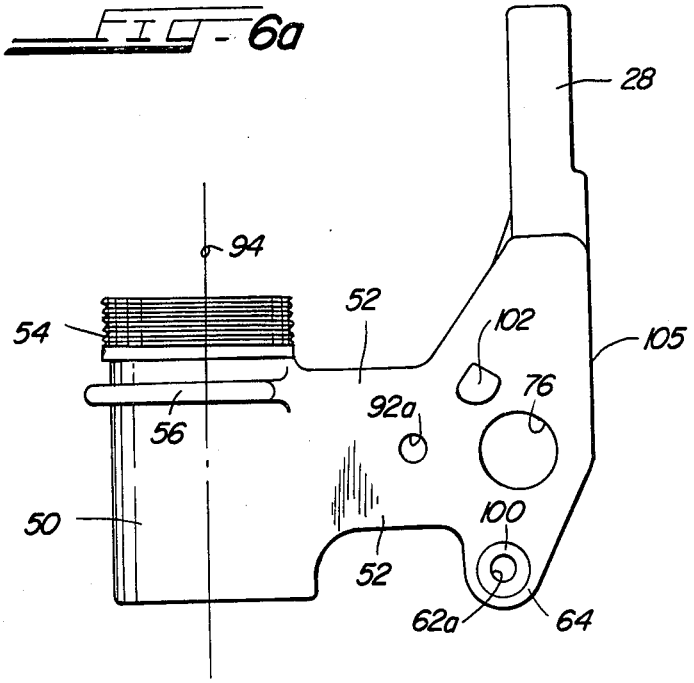
FIG. 6*a* is a side elevation and FIG. 6*b* is a bottom view of a ferrule portion of the upper end fitting depicted in FIG. 5.
Figure 6B:
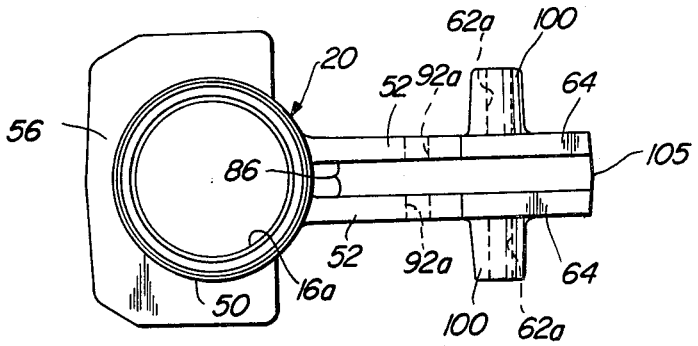
Figure 7B:
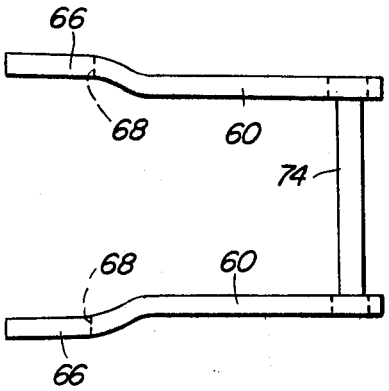
FIG. 7*a* is a side elevation and FIG. 7*b* is a top view of a latch lever forming a portion of the latching facility depicted in FIG. 5.
Figure 7A:
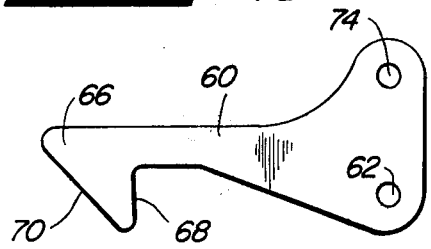

FIGS. 6*a* and 6*b* depict the end fitting 20, including the ferrule 50, its extending leg 52, and the stud contact 28. FIGS. 7*a* and 7*b* depict the levers 60 and the pin 74. In FIG. 7*b*, it may be seen that the free ends 66 of the levers 60 may be formed outwardly to accommodate therebetween, and to avoid interference by, the ferrule 50 or the body of the fuse tube 16. FIG. 8 depicts the arm 78, including the elongated slot 88 and the enlarged hole 90 therethrough, and the pull-ring 80.

Figure 4B:
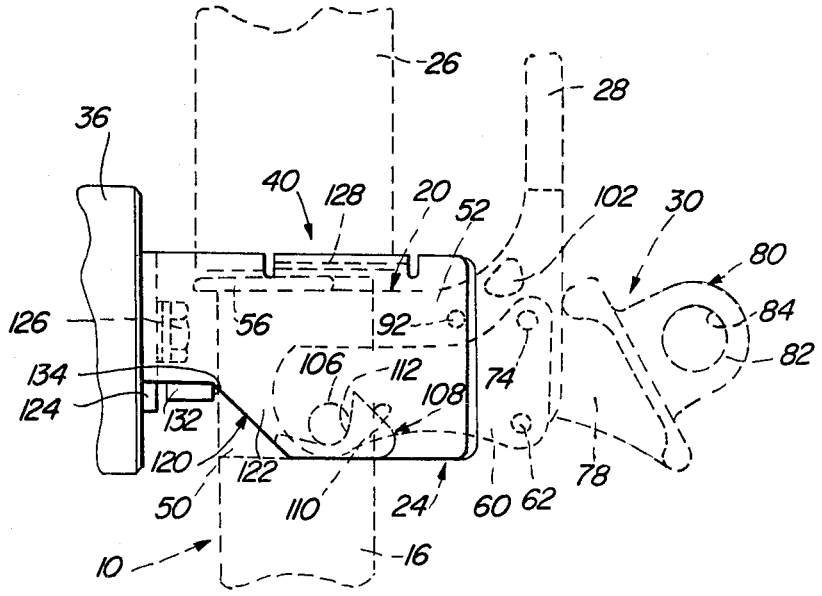
FIG. 4*b* is a side elevation similar to the upper portion of FIG. 2 and shows a portion of a fuse mounting and a portion of a fuse (in phantom) according to an alternative embodiment of the present invention.

As should be obvious, it is not necessary that the free ends 66 of the levers 60 be hook-shaped nor that the bracket 40 include the studs 72. An alternative embodiment of the arrangement previously described is shown in FIG. 4*b* in which the reference numerals from FIG. 2 are utilized where applicable. As can be seen from FIG. 4*b*, the levers 60, rather than including hooks, include studs 106 thereon near the free ends thereof. The bracket 40 contains, on its inside surfaces, hook-like members 108 each having a cam surface 110 and an engaging surface 112. In unlatching the fuse 10, the assembly 30 is pulled to the right, as earlier described, rotating the levers 60 clockwise. Clockwise rotation of the levers 60 moves the studs 106 upwardly and out of engagement with the surfaces 112, permitting the fuse 10 to be opened. Upon closing of the fuse 10, the studs 106 engage the cam surfaces 110 of the hook-like members 108, momentarily rotating the levers 60 clockwise until the studs 106 bypass the hook-like members 108 and are positioned to be engaged by the surfaces 112 by the action of the spring 96, as previously described.

Fuse Mounting 32

The fuse mounting 32 may take various configurations, as may the brackets 38 and 40 thereof and the end fittings 18 and 20 on the fuse 10. This is indicated, for example, by the alternative arrangement for the levers 60 of the latching facility 24 illustrated in, and described with reference to, FIG. 4*b*. Nevertheless, preferred examples of the fuse mounting 32 are here described.

With particular reference to FIGS. 2, 2*a*, 3, 3*a*, 4, and 4*a*, the upper bracket 40 comprises a generally U-shaped member 120 comprising a pair of parallel side plates 122 extending away from the insulator 36 and interconnected by a member 124. The U-shaped member 120 may be attached to the insulator 36 by bolts 126 or other appropriate connectors. The studs 72 (or the members 108 in FIG. 4*b*) are attached, in any convenient manner, to the inside surfaces of the plates 122. The plates 122 may include at their top inwardly directed guide flanges 128 formed as convenient. The guide flanges 128 define guide surfaces 130 (FIGS. 2*a*, 3*a*, and 4) for a purpose described below. A bar 132 may be attached between, and hold rigidly spaced apart, the plates 122 at the rear thereof adjacent the lower end of the interconnecting member 124. The bar 132 has a stop surface 134 on the front thereof. Forward portions 136 of the plates 122 may be flared slightly outwardly to aid in guiding the end fitting 20 and the ferrule 50 thereof between the plates 122, as the fuse 10 undergoes closing movement.

Figure 3:
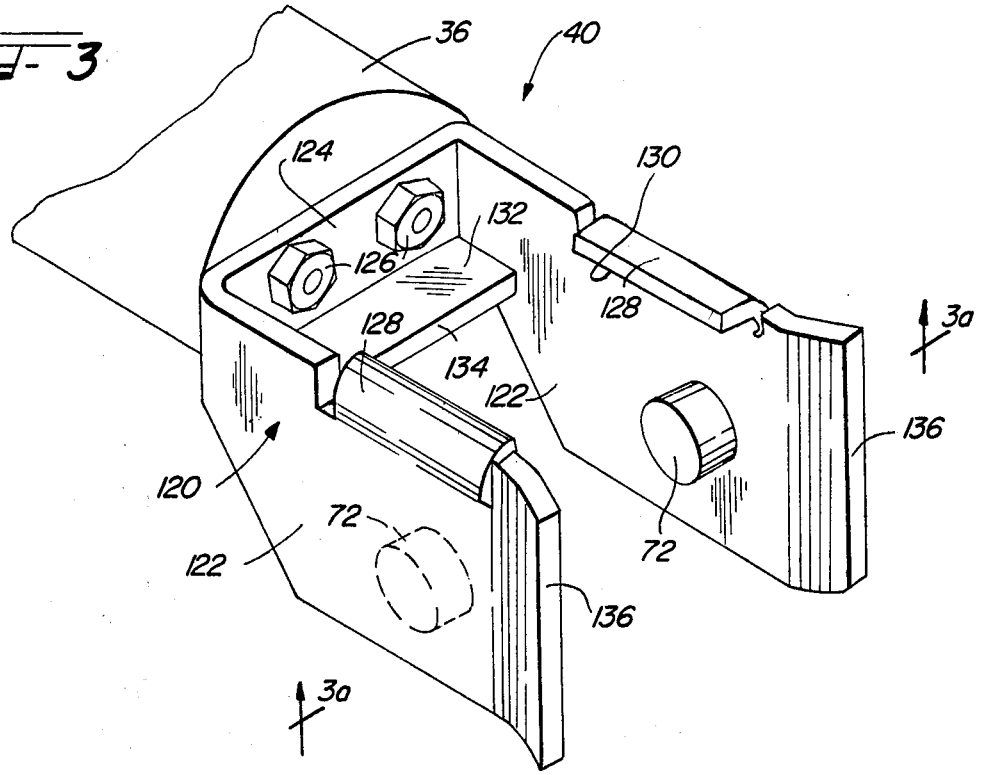
FIG. 3 is a perspective view of an upper bracket of the mounting of FIGS. 2 and 2*a;*
Figure 3A:
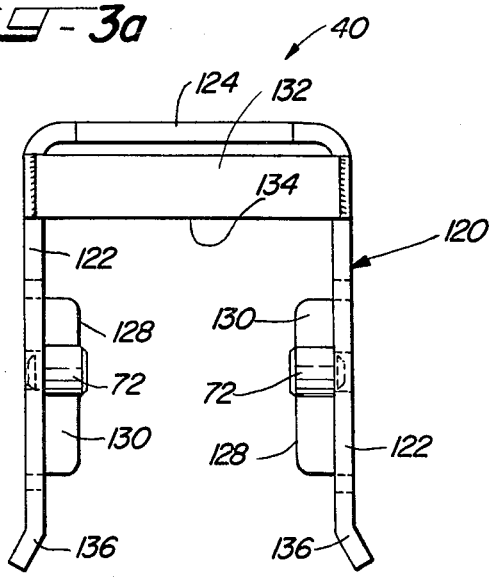
FIG. 3*a* is a bottom view of the upper bracket taken along line 3*a*—3*a* in FIG. 3.

Comparing FIGS. 2*a* and 3 with FIGS. 1 and 5, and also referring to FIG. 2, it may be seen that the distance between the guide surfaces 130 (defined by the flanges 128) and the studs 72 on the inside surfaces of the plates 122 is substantially equal to the distance between the top surface of the flange 56 on the ferrule 50 and the surfaces 68 on the lever 60. This spacing permits the guide surfaces 130 of the flanges 128 to guide the ferrule 50 and the fuse 10 into the bracket 40 as the fuse 10 closes and out of the bracket 40 as the fuse 10 opens. Such guiding prevents, for example, the trunnion 22 from "jumping out" or "wobbling in" in the lower bracket 38 during closing and opening of the fuse 10. The spacing, of course, also insures the ferrule 50 is so positioned at it moves between the plates 122 that the levers 60 properly bypass the studs 72 and the surfaces 68 subsequently properly engage the studs 72. Once the surfaces 68 engage the studs 72, the opposition of the top surface of the flange 56 and the guide surfaces 130 ensures that, absent rightward sliding movement of the pull-ring assembly 30, the surfaces 68 cannot disengage the studs 72. The same function is served by the flange 56 and the guide surfaces 130 in the alternative embodiment of FIG. 4*b*.

In the closed position of the fuse 10, the stop surface 134 may abut the ferrule 50 (see FIGS. 2 and 4*b*). This abutment, along with the engagement of the studs 72 by the surfaces 68, the opposition of the guide surfaces 130 and the flange 56, and the partial surrounding of the ferrule 50 by the side plates 122 ensures that the "top" of the fuse 10, as viewed in FIG. 2, remains latched and cannot move relative to the bracket 40 unless the assembly 30 is properly manipulated. This maintenance of the fuse 10 in the mounting 32 is important in any use environment, but is especially important where the movable panel 12 of the '432 application is utilized. When the panel 12 moves, the fuse 10 must not move or fall out of the mounting 32 and the stud contact 28 must accurately positioned and held in place to reliably engage the stationary contact (not shown) within the enclosure when the panel 12 is manipulated to render the fuse 10 inaccessible.

It should also be noted that engagement between the flange 56 and the guide surfaces 130 during opening of the fuse 10 ensures that the trunnion 22 cannot be removed from the lower bracket 38 until the fuse 10 has rotated clockwise a sufficient amount in the opening direction for such removal to be smoothly effected by the pulling action on the tool grasping the pull ring 80.

Referring now to FIGS. 1, 2, 2*a*, 4, 10, 10*a*, and 10*b*, the lower end fitting 18 with the trunnion 22 thereon and the lower bracket 38 are described.

In one embodiment, and referring to FIG. 1, the lower end fitting 18 comprises a ferrule 140 attached to the fuse tube 16 by pins, adhesives, or the like. The trunnion 22 includes a vertical strut 142 from which depend a pair of plates or ears 144, only one of which is visible in FIGS. 1, 2 and 4. The plates 144 may be attached to or formed integrally with the vertical strut 142. The vertical strut 142 may be attached to the ferrule 140 by one or more screws 146, as shown, or in any other convenient manner.

The outside surfaces of the plates 144 carry trunnion pins 148 which are insertable into hinge openings 150 of the lower bracket 38, as shown in FIGS. 2 and 4. Referring to FIGS. 2, 2*a*, 4 and 10, the lower bracket 38 may be seen to comprise two generally U-shaped members 151 and 152 having side plate pairs 153—153 and 154—154 joined together by a bridge 156. The plates 153 of the lower U-shaped member 151 are generally parallel to each other and extend away from the insulator 34. The plates 154 of the upper U-shaped member 152 are generally parallel to each other and to the plates 153 and also extend away from the insulator 34. The lower bracket 38, including the U-shaped members 151 and 152, may be attached by bolts 158 or other convenient connectors passing through the bridge 156 and threaded into appropriate inserts in the insulator 34. As viewed in FIG. 2, the hinge openings 150 are located at the leftward end of inclined guide slots 160 defined between the top surfaces 153*a* of the lower plates 153 and the bottom surfaces 154*a* of the upper plates 154. The guide slots 160 are sufficiently wide to permit the trunnion pins 148 to freely slide down the surfaces 153*a* into the hinge openings 150. The fuse 10 may be rotated counterclockwise during closing movement or clockwise during opening movement with the trunnion pins 148 resting in and held by the hinge openings 150 for rotation therein.

Figure 10:
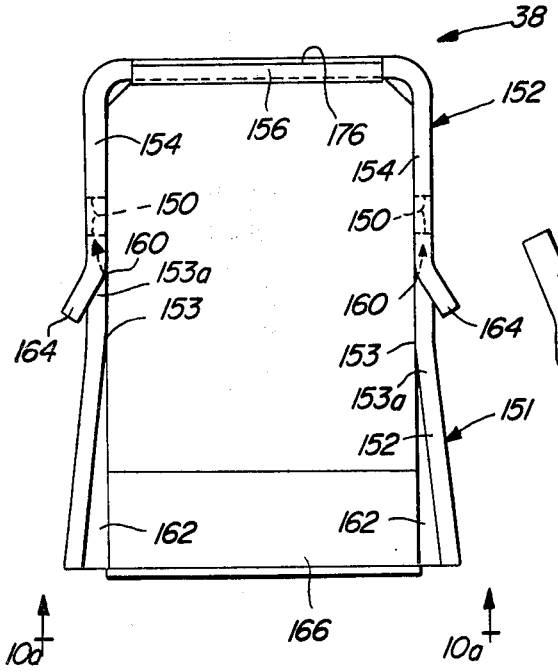
FIG. 10 is an enlarged, top view of the lower bracket depicted in FIGS. 2 and 2*a* and taken along line 10—10 in the latter FIGURE.
Figure 10A:
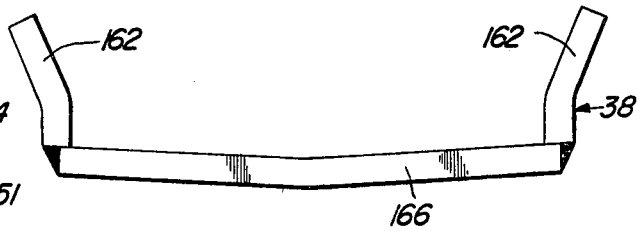
FIG. 10*a* is an end view of the lower bracket depicted in FIG. 10 taken along line 10*a*—10*a* thereof.
Figure 10B:
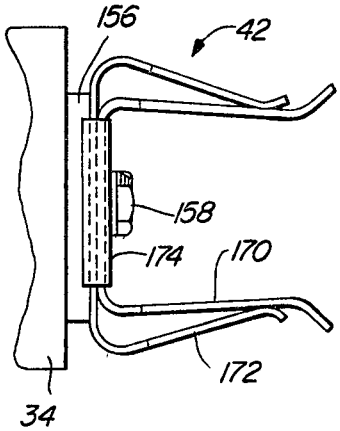
FIG. 10*b* is a top view of a contact portion of the lower bracket depicted in FIGS. 2 and 2*a* and taken along line 10*b*—10*b* in the former FIGURE.

As viewed in FIGS. 10 and 10*a*, the top surfaces 153*a* of the lower plates 153 may be flared slightly outwardly at forward ends 162 thereof to ensure that the plates 144 of the trunnion 22 are guided therebetween and that the trunnion pins 148 enter the guide slots 160. Forward ends 164 of the plates 154 may also be flared slightly outwardly to the same end. The spacing between the surfaces 153*a* and 154*a* and the incline of the guide slots 160 aid in guiding the trunnion pins 148 which rest thereupon during insertion of such trunnion pins 148 into the hinge openings 150 and for removal of the trunnion pins 148 therefrom. To ensure that the trunnion pins 148 do not slip below the top surfaces 153*a* of the plates 153 by flexing thereof, the underside of the forward end of the plates 153 may be connected together by a tie bar 166. The angle of the guide slots 160 is preferably oriented so that the trunnion pins 148 may be removed from the hinge openings 150 by the same pulling motion on a tool grasping the pull ring 80 which unlatched the upper end fitting 20 from the upper bracket 40, as described above, and which rotated the fuse 10 clockwise to its open position.

Where the mounting and latching arrangement 14 of the present invention is used with the invention of the '432 application, the stud contact 28 associated with the upper end fitting 20 effects electrical connection to one end of the fuse 10 via its engagement with the contact (not shown) within the enclosure in which the fuse 10 is inaccessibly located in one position of the panel 12. Because electrical connection at the "top" of the fuse 10 (as viewed in FIG. 2) is ultimately made via the stud contact 28, which is rigidly attached to the fuse tube 16, no special facilities need be associated with the upper bracket 40 or the upper end fitting 20 to ensure same. In effect, the upper bracket 40 and the upper end fitting 20 may serve only to mechanically mount and hold the fuse 10 in the closed position and to accurately locate the stud contact 28, electrical connection to the fuse 10 being effected by positive contact between the stud contact 28 and the stationary contact (not shown) within the enclosure. Where the invention of the '32 application is used, such is not the case at the "bottom" of the fuse 10, as viewed in FIG. 2. Specifically, as already noted, a bushing well insert (not shown) or the like is associated with the bushing well 46 at one end of the insulator 34. An elbow or similar connector (not shown) may then be associated with the bushing-well insert 46 for electrical connection to the conductor 44. Accordingly, positive electrical connection between the conductor 44 and the ferrule 140 of the lower end fitting 18 must be assured when the fuse 10 is in the closed position depicted in FIG. 2. As a consequence, the lower bracket 38 also preferably includes the contact assembly 42.

Referring to FIGS. 2, 2*a*, 4 and 10*b*, the contact assembly 42 may include a generally U-shaped contact 170 surrounded by a generally U-shaped backup spring 172. Both the contact and the backup spring may be furcated by slots 170*a* and 172*a*. The contact 170 and the backup spring 172 may be attached to an upwardly extending portion of the bridge 156 by one of the bolts 158 mounting the lower bracket 38 to the insulator 34.

The contact 170 is made of a metal, such as copper or a copper alloy, which can effect positive electrical connection to the ferrule 140 when the fuse 10 is closed, but which may not necessarily have reliable mechanical spring characteristics. Accordingly, the backup spring 172, which is made of a metal having good mechanical spring characteristics, is formed so as to constantly bear against the legs of the contact 170 and provide the mechanical spring force necessary to firmly engage the contact 170 with the ferrule 140 when the fuse 10 is closed. To ensure good electrical continuity between the contact 170 and the conductive rod 44, a U-shaped shunt 174 may be used. The shunt 174 may be held against the front surface of the contact 170 by the bolt 158. The shunt 174 may be brought back behind an offset 176 formed in the upwardly extending portion of the bridge 156. A rear surface, as viewed in FIG. 2, of the shunt 174 is held against an enlarged head or disk-like portion 178 formed on or attached to the right end of the conductor 144, as shown in FIG. 2. This head 178 is exposed at the rightward end of the insulator 134 for direct mechanical and electrical engagement with the shunt 174.

Where the invention of the '432 application is not used, or where the stud contact 28 is otherwise not present, electrical connection to the "top" of the fuse 10, as viewed in FIG. 2, may be achieved by structure similar to the contact assembly 42. Specifically, a contact assembly 42 may be associated with the upper bracket 40 to engage the ferrule 50 when the fuse 10 is closed in the same manner that the contact assembly 42 of the lower bracket 38 engages the ferrule 140. This additional contact assembly may be connected to a conductor (not shown) within the insulator 36 similar to the conductor 44.

Illustrated in FIGS. 9–9*c* is an alternative embodiment of the lower end fitting 18 and the lower bracket 40 depicted in earlier-described FIGURES. Where applicable, reference numerals from other FIGURES are used.

Referring to FIG. 9, there is shown an end fitting 180, which is an alternative to the end fitting 18, cooperating with both a bracket 182, which is an alternative to the bracket 38, and a contact assembly 184, which is an alternative to the contact assembly 42. The end fitting 180 may be attached to the lower, non-exhaust end of the fuse 10, which has an upside-down orientation similar to that shown in FIG. 1. The bracket 182 is attached to the insulator 34 by the bolts 158. In FIG. 9, as in FIG. 1, the fuse 10 includes the fuse tube 16.

The end fitting 180 comprises a generally cylindrical metallic member 186 which is held onto a metallic tubular portion 188 of the fuse 10 by a pair of ears 190 pulled together by a bolt 192 or similar connector. The cylinder 186 includes at its upper end, as viewed in FIG. 9, an enlarged collar 194, and at its lower end, a protruding lip 196.

The bracket 182 comprises a lower, generally U-shaped extension 198 attached to or integrally formed with a vertical support 200 through which the bolts 158 pass to mount the bracket 182 to the insulator 34. As best seen in FIG. 9*a*, the extension 198 defines a guideway or guide surface 202 for the lower portion of the cylindrical member 186.

The guideway 202 is inclined, as shown in FIG. 9, and merges into a generally horizontal support surface 204. The support surface 204 contains an opening 206 therethrough which has a dimension from left to right, as viewed in FIG. 9, somewhat greater than the left to right dimension of the lower portion of the cylinder 186 measured at the lip 196. The opening 206 has a dimension perpendicular to the plane of FIG. 9 which is substantially equal to the width of the cylinder 186 measured. A support surface 208 is defined on the surface of the cylinder 186 either by enlargement of the cylinder 186 above the lip 196 or by decreasing the size of the cylinder 186 at the lower end thereof in the vicinity of the lip 196. The lip 196, the support surface 204, the hole 206, and the support surface 208 are dimensioned so that, as depicted in FIG. 9, with the fuse 10 in the closed position, the bottom portion of the cylinder 186, including the lip 196 thereon, protrudes through and below the hole 206, while the support surface 208 rests on the support surface 204 on either side of the hole 206. A spring 210 held by one of the bolts 158 to the vertical support 200 of the bracket 182 acts against the ears 190 when the fuse 10 is in the closed position to urge the lip 196 beneath the leftward wall of the hole 206. Thus, the action of the spring 210, the resting of the support surface 208 on the support surface 204, and the protrusion of the lip 196 beyond the forward edge of the hole 206 maintain the end fitting 180 within the bracket 182, as depicted in FIG. 9. Furthermore, the configuration of the guideway 202 is such that when a tool, such as a "shotgun stick" grasping the assembly 30 is used to appropriately manipulate the fuse 10, the lower portion of the cylinder 186, including the lip 196, are placed in the guideway 202 and are easily permitted to move or slide down the inclined guideway 202 into the hole 206. Following entry of the lower portion of the cylinder 186, including the lip 196, into the hole 206, closure of the fuse 10, as earlier described, causes the above-described engagement of the lip 196 with the lower surface of the bracket 182 and engagement of the ears 190 by the spring 210.

Although not shown in FIG. 9, the insulator 34 therein may contain a conductive rod 44 with the head 178 thereon, as shown in FIG. 2. For reasons earlier described, electrical connection to the lower end of the fuse, as depicted in FIG. 9, is ensured not by the engagement between the end fitting 180 and the bracket 182, but rather by electrical and mechanical engagement between the contact assembly 184 and the enlarged collar 194.

Referring to FIG. 9*c*, the contact assembly 184 may be seen to include a generally U-shaped contact 212 having re-entrant leg portions 214 and a generally U-shaped back-up spring 216 which constantly acts against the re-entrant legs 214. The action of the back-up spring 216 on the re-entrant legs 214 of the contact 212 is similar to the function performed by the back-up spring 172 on the contact 170 in FIG. 10*b*. In the embodiments shown in FIGS. 9 and 9*c*, the enlarged head 178 of the conductive rod 144, not shown therein, is in direct electrical and mechanical contact with the interconnecting leg portion of the contact 212.

Thus, the bracket 182 serves to mechanically hold the end fitting 180 and the lower end of the fuse 10 while the contact assembly 184 ensures electrical continuity between an elbow (not shown) connected to the bushing-well insert (not shown) associated with the bushing-well 46 and the conductive rod 44 shown in FIG. 2.

We claim:

1. Improved apparatus for associating an electrical device with a mounting, the mounting including first and second insulatively spaced brackets; each end of the device being adjacent a respective bracket when the device is closed in the mounting; a first end of the device carrying a trunnion which is insertable into and removable from a hinge on the first bracket; the device being rotatable when the trunnion is in the hinge to move a second end of the device toward the second bracket during closing movement of the device and to move the second end of the device away from the second bracket during opening movement of the device; the second end of the device carrying an assembly which is manipulable (a) to insert the trunnion into the hinge, (b) to rotate the device after such insertion for closing the device upon application to the assembly of a pushing force generally transverse to the device, (c) to rotate the device when the trunnion is in the hinge for opening the device upon application to the assembly of a pulling force generally transverse to the device, and (d) to remove the trunnion from the hinge after such opening; the second bracket including a latch member; the second end of the device also carrying latch means movable between a normal first position, whereat the latch member and the latch means are engageable, and a second position, whereat the latch member and the latch means are disengageable, engagement of the latch member and the latch means when the trunnion is in the hinge maintaining the device closed, and disengagement of the latch member and the latch means when the trunnion is in the hinge permitting opening of the device; wherein the improvement comprises:

first means for mounting the assembly to the second end of the device for limited reciprocating movement of the assembly from a first normal location to a second location upon application of the pulling force to the assembly, the first and second locations residing at different distances from the device on a line of reciprocating movement which is generally transverse to the device;

means for moving the latch means out of its first position and toward its second position in response to reciprocating movement of the assembly out of its first location and toward its second location; and second means for mounting the assembly to the second end of the device for limited pivoting thereon relative to the device, which pivoting is independent of the reciprocating movement of the assembly and affects neither the location of the assembly nor the position of the latch means, the line of reciprocating movement of the assembly assuming different generally transverse positions relative to the device in various pivotal orientations of the assembly, so that the pivotal orientation of the assembly is continuously changeable or adjustable before, during, and after the application of the pushing force or the pulling force thereto without affecting the position of the latch means, and so that the assembly may be reciprocated regardless of the pivotal orientation thereof.

2. Improved apparatus as in claim 1, which further comprises:

first means for biasing the assembly toward a predetermined pivotal orientation relative to the device.

3. Improved apparatus as in claim 2, wherein the trunnion is insertable into and removable from the hinge when the device assumes a selected angular orientation relative to the mounting, and the assembly may be grasped by a tool when the trunnion is out of the hinge so that relative motion between the grasped assembly and the tool is limited or prevented; wherein:

the first biasing means is effective to maintain the grasped assembly and the tool in the predetermined pivotal orientation, so that, upon appropriate manipulation of the tool, the device generally assumes and remains in the selected angular orientation relative to the mounting to facilitate insertion of the trunnion into the hinge.

4. Improved apparatus as in claim 3, wherein:

with the trunnion in the hinge and the tool grasping the assembly, application of the pushing force to the grasped assembly by the tool pivots the assembly and the tool against the action of the first biasing means out of the predetermined pivotal orientation as the device undergoes closing movement without affecting the normal position of the latch means, which thereby remains capable of engaging the latch member.

5. Improved apparatus as in claim 4, wherein:

the application of the pushing force to the grasped assembly in a more or less continuous manner is capable of serially effecting insertion of the trunnion into the hinge, closing of the device, and engagement of the latch means with the latch member.

6. Improved apparatus as in claim 1, wherein:

with the trunnion in the hinge and the device closed, the pivotal orientation of the assembly may be adjusted to a convenient angle of attack or may change before, or as a result of, the application of the pulling force to the assembly, the application of the pulling force to the assembly after or concurrently with such adjustment or change reciprocating the assembly to its second location to move the latch means to its second position whereat the latch means and the latch member disengage.

7. Improved apparatus as in claim 6, wherein:

the application of the pulling force to the assembly in a more or less continuous manner with the device closed is capable of serially effecting disengagement of the latch means from the latch member, opening of the device, and removal of the trunnion from the hinge.

8. Improved apparatus as in claim 7, wherein:

the assembly is contactable or engageable by a tool for the appplication thereto of the pulling force for opening the device and removing the trunnion from the hinge.

9. Improved apparatus as in claim 1, which further comprises:

first means for biasing the latch means toward its first position, and second means for biasing the assembly toward its first reciprocating location.

10. Improved apparatus as in claim 9, wherein:

the second biasing means biases the assembly toward its first reciprocating location if the latch means is in its first position or if the latch means is moved out of its first position by reciprocation of the assembly out of its first location.

11. Improved apparatus as in claim 10, wherein:

with the trunnion in the hinge and the device open, application of the pushing force to the assembly effects closing movement of the device, after a sufficient amount of which closing movement the latch means abuts the latch member, such abutment causing the latch means to momentarily bypass the latch member against the action of the first biasing means, following which the latch means is returned to its first position by the first biasing means to engage the latch member and maintain the device closed.

12. Improved apparatus as in claim 11, wherein:
the pushing force, but not the second biasing means, is effective to hold the assembly in its first reciprocating location as the latch means bypasses the latch member.

13. Improved apparatus as in claim 2, which further comprises:
second means for biasing the latch means toward its first position, and
third means for biasing the assembly toward its first reciprocating location.

14. Improved apparatus as in claim 13, wherein:
the third biasing means biases the assembly toward its first reciprocating location if the latch means is in its first position or if the latch means is moved out of its first position by reciprocation of the assembly out of its first location.

15. Improved apparatus as in claim 14, wherein:
the latch means comprises
an elongated lever pivoted at or near one end on the second end of the device for pivotal movement between the first and second positions of the latch means, and
a feature at or near the free end of the lever which is engageable with the latch member in the first position of the lever and is disengageable from the latch member in the second position of the lever.

16. Improved apparatus as in claim 15, wherein:
the moving means comprises
a pin mounted to the lever remotely from the feature and spaced from the pivot point of the lever, and
the second biasing means comprises
a spring acting between the pin and the second end of the device.

17. Improved apparatus as in claim 16, wherein:
the assembly comprises
an arm having a slot and a hole, the slot being elongated generally transverse to the device, the hole being enlarged both generally transverse and parallel to the device, the hole including opposed first and second walls generally transverse to the device and a third wall generally parallel to the device and interconnecting the first and second walls;
the first and second assembly-mounting means comprise
a pivot shaft carried by the second end of the device and passing into the slot to permit both reciprocating movement of the arm thereon and pivoting of the arm thereon, the pin passing into the hole and the pin and the hole being relatively movable so that the arm is pivotable on the pivot shaft between points of abutment between the pin and the first and second walls;
the third biasing means includes
the spring, which biases the pin toward the third wall to bias the lever toward its first position and, if the pin and the third wall abut, to bias the arm toward it first location, reciprocating movement of the arm out of its first location in any pivotal orientation thereof effecting abutment between the third wall and the pin which pivots the lever out of its first position; and
the moving means further comprises
the point of abutment between the pin and the third wall.

18. Improved apparatus as in claim 17, wherein:
the pin and the pivot point of the lever are so related that abutment between the first or second wall and the pin is incapable of pivoting the lever.

19. Improved apparatus in claim 18, wherein:
abutment between the first or second wall and the pin sets the limits of pivoting by the arm.

20. Improved apparatus as in claim 19, wherein:
abutment between the end of the slot and the pivot shaft sets the limits of reciprocating movement of the arm.

21. Improved apparatus as in claim 20, wherein:
the first biasing means comprises
a spring acting between the second end of the device and the arm.

22. Improved apparatus as in claim 9, wherein:
with the trunnion in the hinge and the device closed, the pivotal orientation of the assembly may be adjusted to a convenient angle of attack or may change before, or as a result of, the application of the pulling force to the assembly, the application of the pulling force to the assembly after or concurrently with such adjustment or change reciprocating the assembly to its second location to disengage the latch means from the latch member, and
with the trunnion in the hinge and the device open, during application of the pushing force to the assembly to close the device, the pivotal orientation of the assembly relative to the device may continuously change without affecting the position of the latch means so that as the device is closed the latch means engages the latch member regardless of such pivotal orientation.

23. Improved apparatus as in claim 22, which further comprises:
a fitting mountable to the second end of the device, the end fitting including a leg integral therewith or attached thereto and extending generally transverse to the device; and wherein
the latch means comprises
an elongated lever pivoted at or near one end on the extending leg for pivotal movement between the first and second positions, and
a feature at or near the free end of the lever which is engageable with the latch member in the first position of the lever and is disengageable from the latch member in the second position of the lever;
the first biasing means comprises
a pin mounted to the lever remotely from the feature and spaced from the pivot point of the lever, and
a spring acting between the pin and the extending leg;
the assembly comprises
an arm having a slot and an enlarged hole therethrough, the slot being elongated generally transverse to the device, the hole including opposed first and second walls generally transverse to the device and a third wall generally parallel to the device and interconnecting the first and second walls;
the first and second assembly-mounting means comprise a pivot shaft held by the extending leg and passing into the slot to permit both reciprocating movement of the arm thereon and pivoting of the arm thereon, the pin passing into the hole and the pin and the hole being relatively movable so that the arm is pivotable on the pivot shaft between points of abutment between the pin and the first and second walls;

the second biasing means includes the spring which biases the pin toward the third wall and, if the pin and the third wall abut, biases the arm toward its first location, so that reciprocating movement of the arm out of its first location in any pivotal orientation thereof effects abutment between the third wall and the pin to pivot the lever out of its first position; and the moving means comprises the point of abutment between the pin and the third wall.

24. Improved apparatus as in claim 23, wherein:

one end of the elongated slot abuts the pivot shaft when the arm is in its first location, and the third wall has the general contour of an arc of a circle having as its center the center of the pivot shaft as it abuts the one end of the elongated slot so that, with the arm in its first location and the lever in its first position, the third wall rides under, but does not move, the pin as the arm is pivoted.

25. Improved apparatus as in claim 24, wherein:

the pivot shaft and the pin lie on a first line which is generally transverse to the device, and the pin and the pivot point of the lever lie on a second line which is generally normal to the first line.

26. Improved apparatus as in claim 25, wherein:

the pivot point of the lever and the feature lie on a third line which is spaced from the first line and generally normal to the second line.

27. Improved apparatus as in claim 1, wherein the device is a fuse having an elongated fuse tube, which houses current-interrupting facilities, and at opposed ends of which are respectively mounted first and second end fittings which are electrically continuous via the facilities; wherein the improvement further comprises:

a support member; and first and second insulators on the support member, the insulators having respectively affixed thereto the first and second brackets, the fuse tube being generally parallel to the panel when the fuse is closed.

28. Improved apparatus as in claim 27, wherein:

the support member is a movable panel, movement of the panel moving the closed fuse therewith, the latch means engaging the latch member to maintain the fuse closed during such movement.

29. Improved apparatus as in claim 28, wherein:

the fuse is a high-voltage power fuse having an exhaust end and a non-exhaust end;

the first end fitting is at the non-exhaust end of the fuse; and the second end fitting is at the exhaust end of the fuse and carries the latch means, the first and second mounting means, and the moving means.

30. Improved apparatus as in claim 29, wherein:

the second end fitting comprises a collar mounted to the fuse tube at the exhaust end of the fuse, and means on the collar for mounting thereto an exhaust control device communicating with the exhaust end of the fuse.

31. Improved apparatus as in claim 30, which further comprises:

a prong contact on the second end fitting via which electrical connection to one side of the current-interrupting facilities may be made; and an electrical conductor within and passing through the first insulator, the conductor having a first end electrically connected to the first bracket and a second end via which electrical connection to the other side of the current-interrupting facilities may be made.

32. Improved apparatus as in claim 31, wherein:

with the fuse closed, the fuse tube, the first and second end fittings, the first and second insulators, and the first and second brackets all overlie a first surface of the panel, and the second end of the conductor is accessible from a second opposed surface of the panel.

33. Improved apparatus for associating an electrical device with a mounting, the mounting including first and second insulatively spaced brackets; each end of the device being adjacent a respective bracket when the device is closed in the mounting; one end of the device carrying a trunnion which is insertable into and removable from a hinge on the first bracket when the device assumes a selected angular orientation relative to the mounting; the device being rotatable when the trunnion is in the hinge to move the other end of the device toward the second bracket during closing movement of the device and to move the other end of the device away from the second bracket during opening movement of the device; the other end of the device carrying an assembly contactable by a tool which is manipulable (a) to rotate the device after insertion of the trunnion into the hinge for closing the device upon application to the assembly of a pushing force generally transverse to the device, (b) to rotate the device when the trunnion is in the hinge for opening the device upon application to the assembly of a pulling force generally transverse to the device, and (c) to remove the trunnion from the hinge after such opening; the other end of the device also carrying latch means which is movable between a normal first position, whereat the latch member and the latch means are engageable, and a second position, whereat the latch member and the latch means are disengageable, engagement of the latch member and the latch means when the trunnion is in the hinge maintaining the device closed, and disengagement of the latch member and the latch means when the trunnion is in the hinge permitting opening of the device; wherein the improvement comprises:

first means for mounting the assembly to the other end of the device for limited reciprocating movement of the assembly from a first normal location to a second location upon application of the pulling force to the assembly, the first and second locations residing at different distances from the device on a line of reciprocating movement which is generally transverse to the device;

means for moving the latch means out of its first position and toward its second position in response to reciprocating movement of the assembly out of its first location and toward its second location;

second means for mounting the assembly to the other end of the device for limited pivoting thereon relative to the device, which pivoting is independent of the reciprocating movement of the assembly and affects neither the location of the assembly nor the position of the latch means, the line of reciprocating movement of the assembly assuming different generally transverse positions relative to the device in various pivotal orientations of the assembly, so that the pivotal orientation of the assembly is continuously changeable without affecting the position of the latch means, and so that the assembly may be reciprocated regardless of the pivotal orientation thereof;

means for permitting a tool contacting the assembly to grasp the assembly when the trunnion is out of the hinge so that relative motion between the grasped assembly and the tool is limited or prevented; and biasing means for maintaining the assembly in a predetermined pivotal orientation relative to the device, the biasing means being effective when the trunnion is out of the hinge to maintain the grasped assembly and the tool in the predetermined pivotal orientation so that, upon appropriate manipulation of the tool, the device generally assumes and remains in the selected angular orientation relative to the mounting to facilitate insertion of the trunnion into the hinge, application of the pushing force to the grasped assembly by the tool after the trunnion is in the hinge pivoting the assembly and the tool against the action of the biasing means out of the predetermined pivotal orientation as the device undergoes closing movement without affecting the normal position of the latch means, which thereby remains capable of engaging the latch member.

* * * * *